US009508356B2

(12) United States Patent
Yamanashi et al.

(10) Patent No.: US 9,508,356 B2
(45) Date of Patent: Nov. 29, 2016

(54) ENCODING DEVICE, DECODING DEVICE, ENCODING METHOD AND DECODING METHOD

(75) Inventors: Tomofumi Yamanashi, Kanagawa (JP); Masahiro Oshikiri, Kanagawa (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 707 days.

(21) Appl. No.: 13/641,493

(22) PCT Filed: Apr. 1, 2011

(86) PCT No.: PCT/JP2011/001986

§ 371 (c)(1),
(2), (4) Date: Oct. 16, 2012

(87) PCT Pub. No.: WO2011/132368

PCT Pub. Date: Oct. 27, 2011

(65) Prior Publication Data

US 2013/0035943 A1 Feb. 7, 2013

(30) Foreign Application Priority Data

Apr. 19, 2010 (JP) ..... 2010-096095

(51) Int. Cl.
*G10L 19/00* (2013.01)
*G10L 19/24* (2013.01)
(Continued)

(52) U.S. Cl.
CPC ..... *G10L 19/24* (2013.01); *G10L 19/038* (2013.01); *G10L 2019/0006* (2013.01)

(58) Field of Classification Search
CPC ..... G10L 19/24; G10L 19/0204; G10L 19/0208; G10L 19/005; G10L 19/038; G10L 19/008; G10L 19/0212; G10L 19/083; G10L 19/22; G10L 21/0364; G10L 19/012; G10L 19/02; G10L 19/20; G10L 2019/0006
USPC ..... 704/500, 229, 219, 200.1, 230, 207, 704/203, 226, 265; 375/240.1; 370/328
See application file for complete search history.

(56) References Cited

U.S. PATENT DOCUMENTS 5,842,160 A * 11/1998 Zinser ..... 704/229
5,974,379 A * 10/1999 Hatanaka ..... G10L 19/025 704/224

(Continued)

FOREIGN PATENT DOCUMENTS

JP 11-219197 8/1999
JP 2005-528839 9/2005

(Continued)

OTHER PUBLICATIONS

Intensity Stereo Coding by Jiirgen Herre, Karlheinz Brandenburg and Dieter Lederer presented at the 96th Convention of the Audio Engineering Society, 1994, Amsterdam.*

(Continued)

*Primary Examiner* — Pierre-Louis Desir
*Assistant Examiner* — Neeraj Sharma
(74) *Attorney, Agent, or Firm* — Greenblum & Bernstein, P.L.C.

(57) ABSTRACT

An encoding device is provided for improving decoded signal quality. A local search unit conducts a local search on a plurality of sub-bands generated by dividing spectrum data, and calculates lattice vectors for the spectra in the plurality of sub-bands. A multi-rate indexing unit uses the lattice vectors to perform multi-rate indexing on each of the sub-bands, and generates indexing information showing the results thereof. A band selection unit determines certain sub-bands from amongst the plurality of sub-bands in a plurality of encoding layers as perceptually important sub-band groups, where these are: within a selection range of sub-bands wherein the total number of encoding bits allocated to each of the plurality of sub-bands in the indexing information is equal to or less than an already set value, and within a sub-band selection range with the highest total energy of each of the plurality of sub-bands.

13 Claims, 14 Drawing Sheets

(51) Int. Cl.

| | |
|---|---|
| ***G10L 19/038*** | (2013.01) |
| *G10L 13/00* | (2006.01) |
| *G10L 21/00* | (2013.01) |
| *H04W 4/00* | (2009.01) |
| *H04N 7/12* | (2006.01) |

(56) References Cited

U.S. PATENT DOCUMENTS

| | | | | |
|---|---|---|---|---|
| 7,106,228 | B2 | 9/2006 | Bessette et al. | |
| 8,103,516 | B2 | 1/2012 | Oshikiri | |
| 8,892,450 | B2 * | 11/2014 | Schildbach | G10L 19/173 379/406.01 |
| 8,990,073 | B2 * | 3/2015 | Malenovsky | G10L 25/78 381/94.3 |
| 2002/0010577 | A1 * | 1/2002 | Matsumoto | G10L 19/0212 704/219 |
| 2005/0246178 | A1 * | 11/2005 | Fejzo | G10L 19/0017 704/500 |
| 2005/0285764 | A1 | 12/2005 | Bessette et al. | |
| 2007/0071089 | A1 * | 3/2007 | Kim | G10L 19/24 375/240.1 |
| 2008/0219344 | A1 | 9/2008 | Suzuki et al. | |
| 2008/0319739 | A1 * | 12/2008 | Mehrotra et al. | 704/200.1 |
| 2009/0240491 | A1 * | 9/2009 | Reznik | 704/219 |
| 2010/0017204 | A1 * | 1/2010 | Oshikiri | G10L 19/0208 704/222 |
| 2010/0070269 | A1 * | 3/2010 | Gao | G10L 19/04 704/207 |
| 2010/0121646 | A1 * | 5/2010 | Ragot | G10L 19/0204 704/500 |
| 2010/0169081 | A1 * | 7/2010 | Yamanashi | G10L 19/0204 704/203 |
| 2010/0169087 | A1 * | 7/2010 | Ashley | G10L 19/24 704/225 |
| 2010/0228541 | A1 | 9/2010 | Oshikiri | |
| 2010/0286990 | A1 * | 11/2010 | Biswas | G10L 19/035 704/500 |
| 2011/0004466 | A1 * | 1/2011 | Morii | G10L 19/008 704/201 |
| 2011/0022402 | A1 * | 1/2011 | Engdegard | H04S 7/30 704/501 |
| 2011/0046946 | A1 * | 2/2011 | Liu | G10L 19/008 704/203 |
| 2011/0270616 | A1 * | 11/2011 | Garudadri | G10L 19/02 704/500 |
| 2011/0282674 | A1 * | 11/2011 | Ojanpera | H04S 3/008 704/500 |

FOREIGN PATENT DOCUMENTS

| | | |
|---|---|---|
| JP | 2008-224902 | 9/2008 |
| WO | 2005/078706 | 8/2005 |
| WO | 2007/063913 | 6/2007 |

OTHER PUBLICATIONS

"3rd Generation Partnership Project; Technical Specification Group Service and System Aspects; Audio codec processing functions; Extended AMR Wideband codec; Trancoding functions (Release 6)", 3GPP TS 26.290, V1.0.0, Jun. 2004.

Extended European Search Report, mailed Jul. 1, 2014, from the European Patent Office (E.P.O.) for the corresponding European Patent Application.

"Frame error robust narrow-band and wideband embedded variable bit-rate coding of speech and audio from 8-32 kbit/s", ITU-T: G.718, Jun. 2008.

Stephane Ragot et al., "Low-Complexity Multi-Rate Lattice Vector Quantization With Application to Wideband TCX Speech Coding at 32 Kbit/s", University of Sherbrooke, Quebec, Canada, IEEE, ICASSP 2004, pp. I-501 to I-504.

Minjie Xie et al., "Embedded Algebraic Vector Quantizers (EAVQ) With Application to Wideband Speech Coding", University of Sherbrooke, Quebec, Canada, IEEE, 1996, pp. 240-243.

International Search Report, mailed Jul. 12, 2011, for corresponding International Application No. PCT/JP2011/001986.

* cited by examiner

FIG6A:STEP1
SECOND ENTRY
IMPORTANT SUBBAND GROUP
1
2
3
4
5
$B_1$ $E_1$
$B_2$ $E_2$
$B_3$ $E_3$
$B_4$ $E_4$
$B_5$ $E_5$
SUBBAND
FIG6B:STEP2
SECOND ENTRY
IMPORTANT SUBBAND GROUP
LOWER FREQUENCY SUBBAND GROUP
HIGHER FREQUENCY SUBBAND GROUP
SUBBAND
FIG6C:STEP3
SECOND ENTRY
IMPORTANT SUBBAND GROUP
LOWER FREQUENCY SUBBAND GROUP
HIGHER FREQUENCY SUBBAND GROUP
SUBBAND

FIG.8A: STEP1
CALCULATE FREQUENCY BAND OF TOP SUBBAND FROM BAND CODED INFORMATION
IMPORTANT SUBBAND GROUP DESIGNATED ACCORDING TO BAND CODED INFORMATION AND THE NUMBER OF USED BITS)
1
2
3
4
5
SUBBAND
$B_1$ $E_1$
$B_2$ $E_2$
$B_3$ $E_3$
$B_4$ $E_4$
$B_5$ $E_5$
FIG.8B: STEP2
IMPORTANT SUBBAND GROUP
LOWER FREQUENCY SUBBAND GROUP
HIGHER FREQUENCY SUBBAND GROUP
FIG.8C: STEP3

ENCODING DEVICE, DECODING DEVICE, ENCODING METHOD AND DECODING METHOD

TECHNICAL FIELD

The present invention relates to a coding apparatus, a decoding apparatus, a coding method, and a decoding method used for a communication system that encodes and transmits a signal.

BACKGROUND ART

Upon transmitting a speech signal or an audio signal in, for example, a packet communication system or a mobile communication system, which is typified by Internet communication, compression techniques or coding techniques are often used to improve the efficiency of transmission of the speech signal or the audio signal. Recently, there is a growing need for techniques which simply encode a speech signal or an audio signal at a low bit rate and encode a speech signal or an audio signal of a wider band with high quality.

In order to meet this need, scalable coding techniques have been developed whereby it is possible to decode a speech signal or an audio signal from part of encoded information and it is possible to limit the degradation of sound quality even in a situation where packet loss occurs in speech signal or audio signal coding (see Non-Patent Literature 1). Non-Patent Literature 1, for example, discloses "EAVQ (Embedded Algebraic Vector Quantization)," a technique which divides spectrum data acquired by converting a predetermined time of an input signal into a plurality of sub-vectors and performs multi-rate coding on each sub-vector when a coding bit rate is 16 kbps to 24 kbps and when an input signal is determined to be a speech signal. Non-Patent Literature 2, Non-Patent Literature 3, and Patent Literature 1 also disclose a technique related to EAVQ disclosed in the above mentioned Non-Patent Literature 1.

CITATION LIST

Patent Literature

PLT 1
Japanese Translation of a PCT Application Laid-Open No. 2005-528839

Non-Patent Literature

NPL 1
ITU-T:G.718; Frame error robust narrowband and wideband embedded variable bit-rate coding of speech and audio from 8-32 kbit/s. ITU-T Recommendation G.718 (2008)
NPL 2
Stephane Ragot, Bruno Bessette, and Roch Lefebvre, "Low-complexity Multi-rate Lattice Vector Quantization with Application to Wideband TCX Speech Coding," ICASSP 2004
NPL 3
Minjie Xie and Jean-Pierre Adoul, "Embedded Algebraic Vector Quantizers (EAVQ) with Application to Wideband Speech Coding," IEEE 1996

SUMMARY OF INVENTION

Technical Problem

However, the configurations of the coding apparatus and the decoding apparatus disclosed in the above mentioned Non-Patent Literature 1 have a problem in which the quality of a decoded signal is not satisfactory with respect to encoding/decoding using part of bit rates. This problem will be described below.

An EAVQ coding scheme is applied to the coding apparatus and the decoding apparatus disclosed in the above mentioned Non-Patent Literature 1 at a coding bit rate of 16 kbps to 24 kbps when an input signal is determined to be a speech signal. In this case, a bit rate available for EAVQ is 4 kbps to 12 kbps excluding bit rates of a core coding layer (layer 1) and the first extended layer (layer 2). More specifically, the coding apparatus performs coding in layer 3 at a bit rate of 4 kbps and in layer 4 at a bit rate of 8 kbps. The coding apparatus further performs coding in layer 5 at a bit rate of 8 kbps when the coding bit rate is 32 kbps. Since this coding layer does not essentially relate to the present invention, it is omitted in the following explanation.

The above mentioned Non-Patent Literature 1 performs coding processes of layer 3 and layer 4 together in the coding apparatus, transmits a coded parameter corresponding to a total bit rate of 12 kbps to a decoding apparatus, and performs decoding in the decoding apparatus at a desired bit rate. With this technique, a coded parameter of layer 3 (4 kbps) and a coded parameter of layer 4 (8 kbps) of the transmitted coded parameter are not distinguished. For this reason, the decoding apparatus is configured to simply perform a decoding process on only a parameter of a desired bit rate (4 kbps or 12 kbps) from the top of the received coded parameter (12 kbps). Accordingly, when decoding a coded parameter at a bit rate corresponding to layer 1 to layer 3 (12 kbps), for example, the decoding apparatus does not perform a decoding process by selecting a specific part which is perceptually important in a coded parameter of layer 3 and layer 4. Thus, it cannot be said that the quality of the decoded signal is sufficient under this decoding condition.

It is an object of the present invention to provide a scalable coding/decoding method that partially selects a specific coded parameter which is perceptually important in a coding apparatus and reflects the degree of perceptual importance on the coded parameter in a scalable coding/decoding method as disclosed in Non-Patent Literature 1, thereby improving the quality of a decoded signal in decoding at part of bit rates.

Solution to Problem

A coding apparatus according to a first aspect of the present invention is a coding apparatus that includes a plurality of coding layers for performing coding processes together, and employs a configuration to include a searching section that divides spectrum data inputted to the plurality of coding layers to generate a plurality of subbands, performs a neighborhood search for the plurality of subbands, and calculates lattice vectors for the spectra of the plurality of subbands; a coding section that performs multi-rate indexing for each of the plurality of subbands using a corresponding one of the lattice vectors and generates index information indicating a result of the multi-rate indexing for each of the plurality of subbands; and a selecting section that determines a selection range of subbands as a specific subband group in the plurality of coding layers using the number of coding bits assigned to each of the plurality of subbands in the index information and a subband energy which is an energy of each of the plurality of subbands, the selection range of subbands being a range in which a total number of the coding bits is equal to or less than a preset value and a total of the subband energies is the highest among the plurality of subbands.

A decoding apparatus according to a second aspect of the present invention is a decoding apparatus that decodes a signal from a coding apparatus including a plurality of coding layers for performing coding processes together, and employs a configuration to include a receiving section that receives index information and band information which are generated in the coding apparatus, the index information indicating a result of multi-rate indexing for each of a plurality of subbands using a lattice vector acquired by a neighborhood search for the plurality of subbands generated by dividing spectrum data inputted to the plurality of coding layers, band information indicating a specific subband group which is a selection range of subbands and being determined using coding bits assigned to each of the plurality of subbands and a subband energy which is an energy of each of the plurality of subbands, the selection range of subbands being a range in which a total number of coding bits assigned to each of the plurality of subbands in the multi-rate indexing is equal to or less than a preset value and a total of subband energies which are the energies of the plurality of subbands is the highest among the plurality of subbands; and a decoding section that decodes only a part corresponding to the specific subband group indicated by the band information in the index information and generates a decoded signal when a decoding process is performed in only part of the plurality of coding layers.

A coding method according to a third aspect of the present invention is a coding method in a coding apparatus including a plurality of coding layers for performing coding processes together, and employs a configuration to include a searching step of dividing spectrum data inputted to the plurality of coding layers to generate a plurality of subbands, performing a neighborhood search for the plurality of subbands, and calculating lattice vectors for the spectra of the plurality of subbands; a coding step of performing multi-rate indexing for each of the plurality of subbands using a corresponding one of the lattice vectors and generating index information indicating a result of the multi-rate indexing for each of the plurality of subbands; and a selecting step of determining a selection range of subbands as a specific subband group in the plurality of coding layers using the number of coding bits assigned to each of the plurality of subbands in the index information and a subband energy which is an energy of each of the plurality of subbands, the selection range of subbands being a range in which a total number of the coding bits is equal to or less than a preset value and a total of the subband energies is the highest among the plurality of subbands.

A decoding method according to a fourth aspect of the present invention is a decoding method in a decoding apparatus that decodes a signal from a coding apparatus including a plurality of coding layers for performing coding processes together, and employs a configuration to include a receiving step of receiving index information and band information which are generated in the coding apparatus, the index information indicating a result of multi-rate indexing for each of a plurality of subbands using a lattice vector acquired by a neighborhood search for the plurality of subbands generated by dividing spectrum data inputted to the plurality of coding layers, band information indicating a specific subband group which is a selection range of subbands and being determined using coding bits assigned to each of the plurality of subbands and a subband energy which is an energy of each of the plurality of subbands, the selection range of subbands being a range in which a total number of coding bits assigned to each of the plurality of subbands in the multi-rate indexing is equal to or less than a preset value and a total of subband energies which are energies of the plurality of subbands is the highest among the plurality of subbands; and a decoding step of decoding only part corresponding to the specific subband group indicated by the band information in the index information and generating a decoded signal when a decoding process is performed in only part of the plurality of coding layers.

Advantageous Effects of Invention

According to the present invention, it is possible to perform a coding process and a coded parameter generating process by taking the degree of perceptual importance into account, thereby making it possible to improve the quality of a decoded signal.

DESCRIPTION OF EMBODIMENTS

Hereinafter, embodiments of the present invention will be explained in detail with reference to the drawings. A coding apparatus and decoding apparatus according to the present invention will be described using a speech coding apparatus and a speech decoding apparatus as examples.

Embodiment 1

Figure 1:
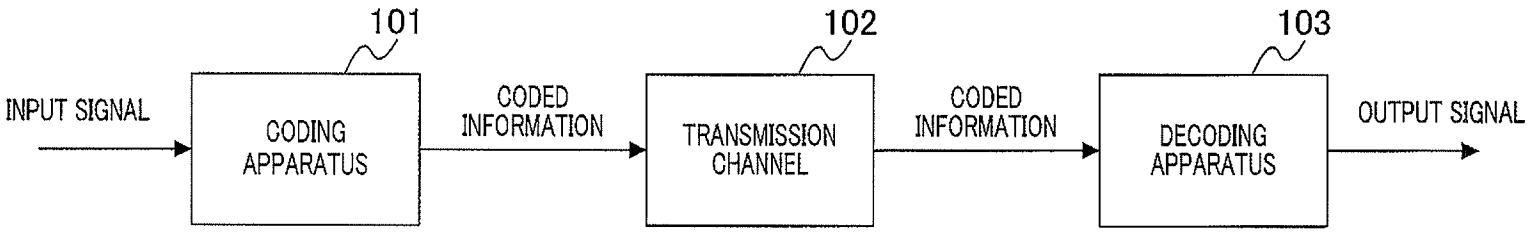
FIG. 1 is a block diagram showing a configuration of a communication system including a coding apparatus and a decoding apparatus according to Embodiment 1 of the present invention.

FIG. 1 is a block diagram showing a configuration of a communication system including a coding apparatus and a decoding apparatus according to the present embodiment. In FIG. 1, a communication system includes coding apparatus 101 and decoding apparatus 103. Coding apparatus 101 and decoding apparatus 103 can communicate with each other through transmission channel 102. The coding apparatus and the decoding apparatus are usually installed in a base station apparatus or a communication terminal apparatus and so on for use.

Coding apparatus 101 divides an input signal every N samples (N refers to a natural number) and performs coding every frame including N samples. In other words, N samples constitute a coding processing unit. An input signal corresponding to individual coding processing units is represented as $x_n$ (n=0, . . . , N−1). Moreover, n represents the n+1-th signal element among the signal element groups, each of which includes the N samples resulting from division of the input signal. Coding apparatus 101 transmits information acquired by coding (hereinafter, referred to as "coded information") to decoding apparatus 103 through transmission channel 102.

Decoding apparatus 103 receives the coded information transmitted from coding apparatus 101 through transmission channel 102 and decodes the received coded information to acquire an output signal.

Figure 2:
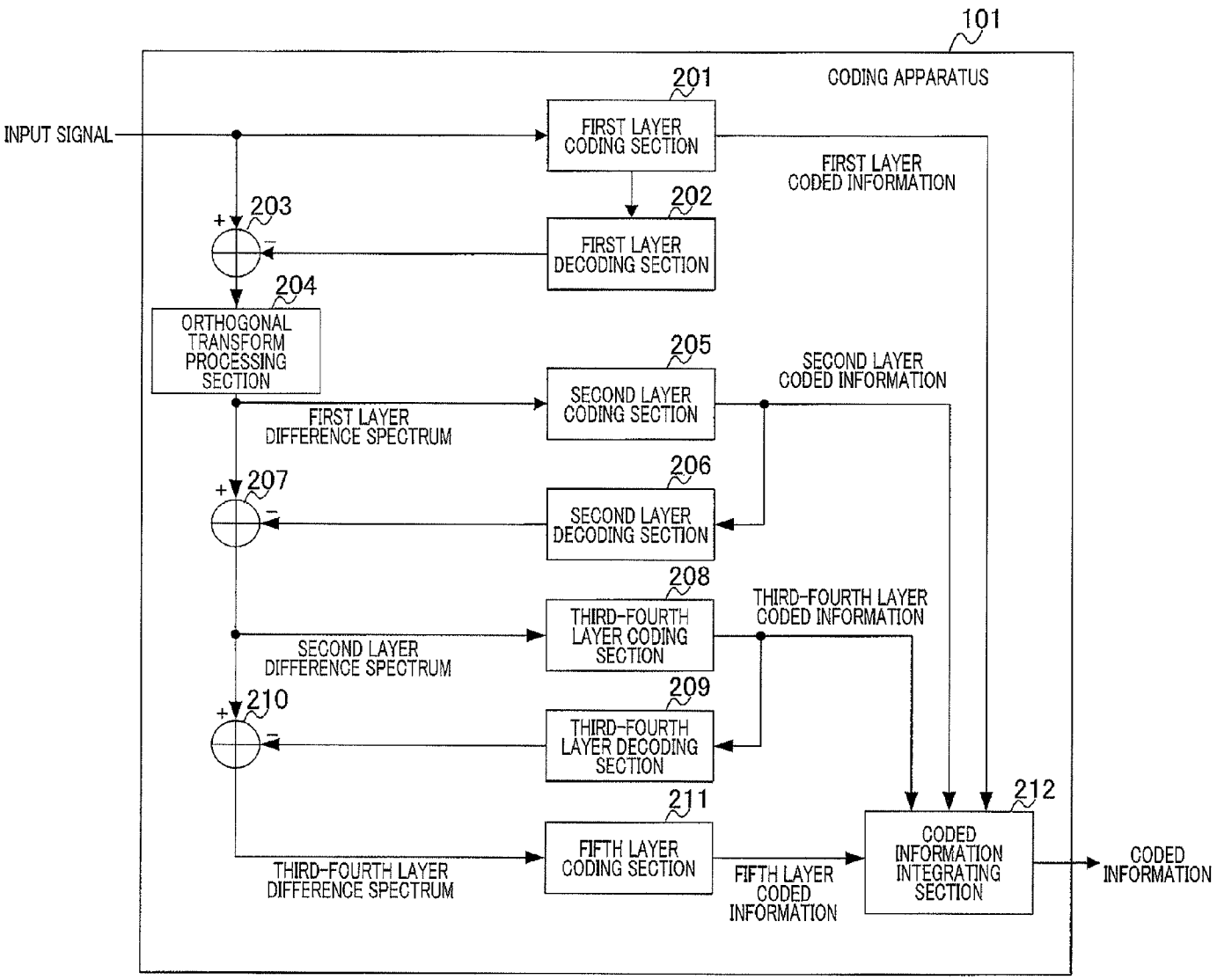
FIG. 2 is a block diagram showing a main configuration inside the coding apparatus shown in FIG. 1.

FIG. 2 is a block diagram showing a main configuration inside the coding apparatus 101 shown in FIG. 1. Coding apparatus 101 is a layer coding apparatus including five coding layers as an example. Hereinafter, each of the five coding layers is referred to as the first layer, the second layer, the third layer, the fourth layer, and the fifth layer in ascending order of bit rate. The configuration of coding apparatus 101 described in the present embodiment employs the configuration similar to the coding apparatus in Non-Patent Literature 1. However, the configuration of coding apparatus 101 described in the present embodiment is one for a coding process in a case where an input signal is determined to be a speech signal. In addition, since coding apparatus 101 performs a coding/decoding process in the third layer and the fourth layer together, FIG. 2 integrates the third layer and the fourth layer and represents the integrated layer as the third and fourth layer. In coding apparatus 101, the components other than a third and fourth layer coding section are the same as the components disclosed in Non-Patent Literature 1, and therefore a detailed explanation thereof will be omitted.

First layer coding section 201 of coding apparatus 101 shown in FIG. 2 encodes an input signal using a CELP (Code Excited Linear Prediction) speech coding method to generate first layer coded information, and outputs the generated first layer coded information to first layer decoding section 202 and coded information integrating section 212.

First layer decoding section 202 decodes the first layer coded information received from first layer coding section 201, using a CELP speech decoding method to generate a first layer decoded signal, and outputs the generated first layer decoded signal to adding section 203.

Adding section 203 inverts the polarity of the first layer decoded signal received from first layer decoding section 202, adds the resultant signal to the input signal, to calculate a difference signal between the input signal and the first layer decoded signal, and outputs the acquired difference signal to orthogonal transform processing section 204 as the first layer difference signal.

Orthogonal transform processing section 204 has buffer buf1($n$) (n=0, . . . , N−1) inside, and converts first layer difference signal x1($n$) received from adding section 203 into a frequency-domain parameter (i.e., a frequency-domain signal, in other words, spectrum data) by Modified Discrete Cosine Transform (MDCT, in other words, an orthogonal transformation).

Regarding the orthogonal transformation in orthogonal transform processing section 204, the calculation steps and data output to the internal buffer thereof will be described.

Orthogonal transform processing section 204 first initializes buffer buf1($n$) by setting an initial value to "0" in accordance with following equation 1.

[1]

$$\mathrm{buf1}(n)=0(n=0, \ldots, N-1) \quad \text{(Equation 1)}$$

Orthogonal transform processing section 204 performs a modified discrete cosine transform (MDCT) on first layer difference signal x1($n$) in accordance with following equation 2 and acquires an MDCT coefficient (hereinafter, referred to as "first layer difference spectrum") X1($k$) of first layer difference signal x1($n$).

[2]

$$X1(k) = \frac{2}{N}\sum_{n=0}^{2N-1} x1'(n)\cos\left[\frac{(2n+1+N)(2k+1)\pi}{4N}\right] \quad \text{(Equation 2)}$$

$$(k = 0, \ldots, N-1)$$

K is the index of each sample in a frame. Orthogonal transform processing section 204 acquires vector x1'($n$) resulting from combining first layer difference signal x1($n$) with buffer buf1($n$) in accordance with following equation 3.

[3]

$$x1'(n) = \begin{cases} buf1(n) & (n = 0, \ldots N-1) \\ x1(n-N) & (n = N, \ldots 2N-1) \end{cases} \quad \text{(Equation 3)}$$

Next, orthogonal transform processing section 204 updates buffer bull (n) in accordance with following equation 4.

[4]

$$\mathrm{buf1}(n)=x1(n)(n=0, \ldots N-1) \quad \text{(Equation 4)}$$

Orthogonal transform processing section 204 outputs first layer difference spectrum X1($k$) (i.e., spectrum data acquired by an orthogonal transformation for the first layer difference signal) to second layer coding section 205 and adding section 207.

Second layer coding section 205 generates the second layer coded information using first layer difference spectrum X1($k$) received from orthogonal transform processing section 204 and outputs the generated second layer coded information to second layer decoding section 206 and coded information integrating section 212. Because Non-Patent Literature 1 discloses second layer coding section 205 in detail, the description thereof will be omitted from the present embodiment.

Second layer decoding section 206 decodes the second layer coded information received from second layer coding section 205, calculates the second layer decoded spectrum, and outputs the calculated second layer decoded spectrum to adding section 207. Because Non-Patent Literature 1 discloses second layer decoding section 206 in detail, the description thereof will be omitted from the present embodiment.

Adding section 207 inverts the polarity of the second layer decoded spectrum received from second layer decoding section 206, adds the resultant spectrum to first layer difference spectrum received from orthogonal transform processing section 204, to calculate a difference spectrum between the first layer difference spectrum and the second layer decoded spectrum. Adding section 207 then outputs the acquired difference spectrum to third and fourth layer coding section 208 and adding section 210 as the second layer difference spectrum.

Third and fourth layer coding section 208 generates the third and fourth layer coded information using the second layer difference spectrum received from adding section 207. Third and fourth layer coding section 208 then outputs the generated third and fourth layer coded information to third and fourth layer decoding section 209 and coded information integrating section 212. Details of third and fourth layer coding section 208 will be described hereinafter.

Third and fourth layer decoding section 209 decodes the third and fourth layer coded information received from third and fourth layer coding section 208, calculates the third and fourth layer decoded spectrum, and outputs the calculated third and fourth layer decoded spectrum to adding section 210. Details of third and fourth layer decoding section 209 will be described hereinafter.

Adding section 210 inverts the polarity of the third and fourth layer decoded spectrum received from third and fourth layer decoding section 209, adds the resultant spectrum to the second layer difference spectrum received from adding section 207, to thereby calculate a difference spectrum between the second layer difference spectrum and the third and fourth layer decoded spectrum. Adding section 210 outputs the acquired difference spectrum to fifth layer coding section 211 as the third and fourth layer difference spectrum.

Fifth layer coding section 211 generates the fifth layer coded information using the third and fourth layer difference spectrum received from adding section 210. Fifth layer coding section 211 outputs the generated fifth layer coded information to coded information integrating section 212. Because Non-Patent Literature 1 discloses fifth layer coding section 211 in detail, the description thereof will be omitted from the present embodiment.

Coded information integrating section 212 integrates the first layer coded information received from first layer coding section 201, the second layer coded information received from second layer coding section 205, the third and fourth layer coded information received from third and fourth layer coding section 208, and the fifth layer coded information received from fifth layer coding section 211. Coded information integrating section 212 adds a transmission error code and/or the like to the integrated information source code as necessary and outputs the resultant code to transmission channel 102 as coded information.

Figure 3:
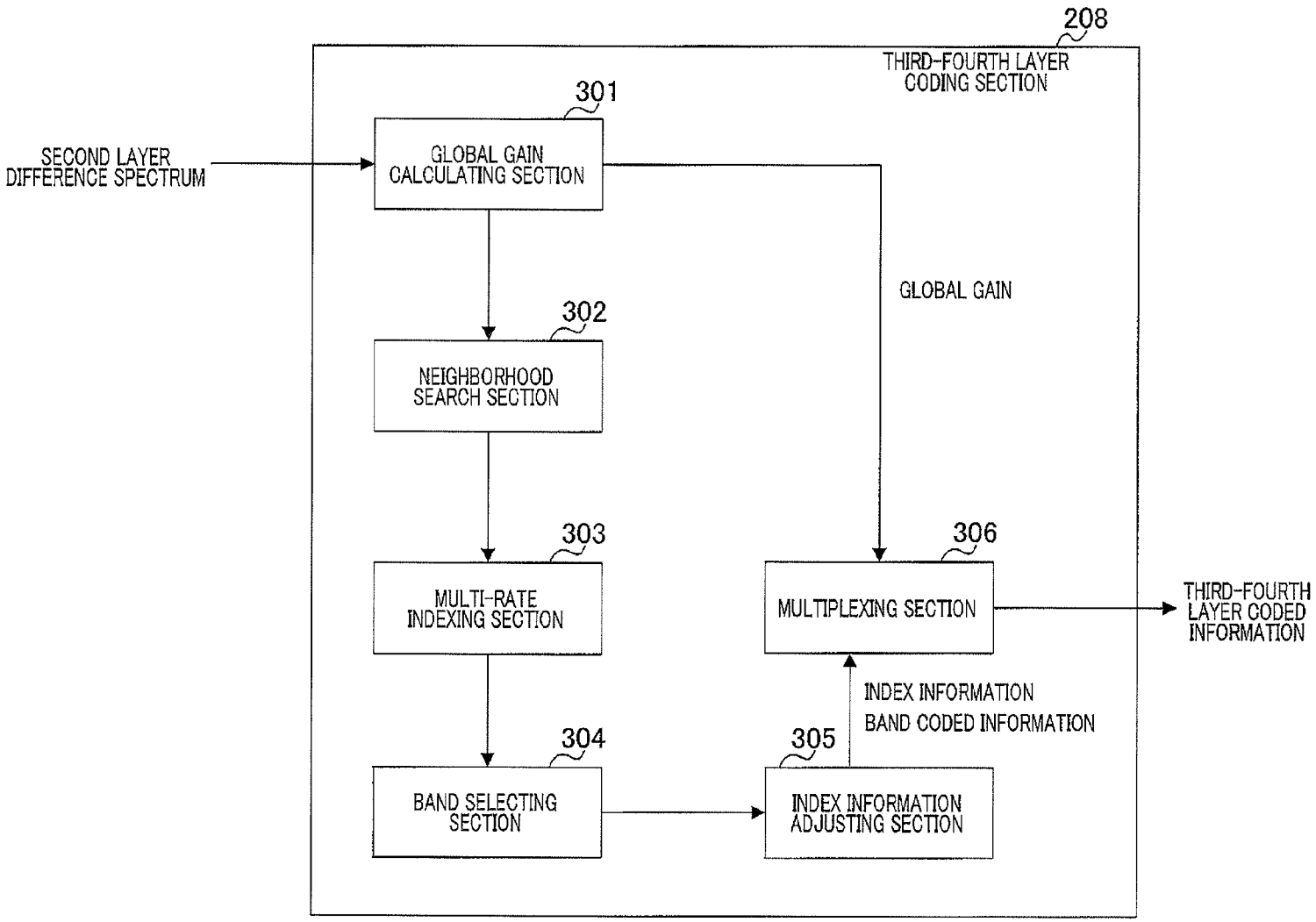
FIG. 3 is a block diagram showing a main configuration inside the third and fourth layer coding section shown in FIG. 2.

FIG. 3 is a block diagram showing a main configuration inside third and fourth layer coding section 208 shown in FIG. 2. Third and fourth layer coding section 208 is mainly formed of global gain calculating section 301, neighborhood search section 302, multi-rate indexing section 303, band selecting section 304, index information adjusting section 305, and multiplexing section 306. Each section performs the following operations.

Global gain calculating section 301 calculates a global gain for second layer difference spectrum X2($k$) received from adding section 207. Non-Patent Literature 1 discloses a calculating method of the global gain, and the present embodiment uses the same calculating method. Specifically, global gain calculating section 301 calculates global gain g in accordance with following equations 5 and 6. Global gain calculating section 301 outputs global gain g calculated in accordance with equation 6 to multiplexing section 306. NB_BITS in equation 5 represents the number of bits available for a coding process and P represents the number of subbands for division of second layer difference spectrum X2($k$).

[5]

$$\begin{aligned}
&\text{Initialize } fac = 128,\ \text{offset} = 0, \\
&nbits_{max} = 0.95 \cdot (\text{NB_BITS} - P) \\
&\quad \text{for } i = 1{:}10 \\
&\qquad \text{offset} = \text{offset} + fac \\
&\qquad nbits = \sum_{p=1}^{P} \max(0, R_p(1) - \text{offset}) \\
&\qquad \text{if } nbits \le nbits_{max}, \text{ then} \\
&\qquad\quad \text{offset} = \text{offset} - fac \\
&\qquad\quad fac = fac/2
\end{aligned} \tag{Equation 3}$$

[6]

$$g = 10^{\left(\frac{offset\ \log_{10}(2)}{10}\right)} \tag{Equation 6}$$

To be more specific, the first step of equation 5 describes an equation related to initialization. After initialization, the first offset calculation is performed using the equation in the third step of equation 5. On the other hand, the second offset calculation is performed using the equations in the sixth and seventh steps of equation 5. Also, nbits is calculated from the equation in the fourth step of equation 5. The offset calculated from the first offset calculation or the offset calculated from the second offset calculation is selected based on the condition in the fifth step of equation 5. In other words, when the condition in the fifth step of equation 5 is not satisfied, the offset calculated from the first offset calculation is selected. On the other hand, when the condition in the fifth step of equation 5 is satisfied, the offset calculated from the second offset calculation is selected.

In equation 6, global gain g is calculated based on the selected offset in equation 5. This global gain g is outputted to multiplexing section 306.

Global gain calculating section 301 also normalizes second layer difference spectrum X2($k$) using global gain g calculated from equation 6, in accordance with equation 7, and outputs the normalized second layer difference spectrum X'2($k$) to neighborhood search section 302.

[7]

$$X'2(k) = X2(k)/g(k=0, \ldots, N-1) \tag{Equation 7}$$

Neighborhood search section 302 divides the normalized second layer difference spectrum X'2($k$) (spectrum data) received from global gain calculating section 301 into P subbands as with the process in global gain calculating section 301. The number of samples (an MDCT coefficient) forming each of P subbands (i.e., a subband width) is set to be Q(p). Hereinafter, although a case where every subband width is Q will be described for simplification of the description, the present invention likewise applies to a case where the subband widths differ at every subband.

Neighborhood search section 302 performs a neighborhood search process on a spectrum of each of P subbands resulting from the division. In the following description, a spectrum of each subband is referred to as sub-spectrum $SS_p(k)$ ($p=0, \ldots, P-1$, $k=BS_p, \ldots, BE_p$). $BS_p$ represents an index of the top sample of each subband and $BE_p$ represents an index of the last sample of each subband. Neighborhood search section 302 employs the technique disclosed in Non-Patent Literature 1 and Non-Patent Literature 3 for sub-spectrum $SS_p(k)$ and calculates a neighborhood vector (a lattice vector) of sub-spectrum $SS_p(k)$. Specifically, neighborhood search section 302 calculates a sub-vector (a lattice vector (a lattice point) $y_{1p}$ or $y_{2p}$) included in $RE_8$ in accordance with following equation 8. $RE_8$ refers to a set of so-called rotated Gosset lattices. See Non-Patent Literature 1 and Non-Patent Literature 2 for details of $RE_8$ and process of and equation 8.

[8]

set $z_p=0.5\cdot X2(k)$

Round each component of $z_p$ to the nearest integer, to generate $z'_p$

Set $y_{1p}=2^{z'_p}$

Calculate $S$ as the sum of the components of $y_{1p}$ if $S$ is not an integer multiple of 4, then modify one of its components as follows:

find the position $I$ where $\mathrm{abs}[z_p(i)-y_{1p}(i)]$ is the highest if $z_p(I)-y_{1p}(I)<0$, then $y_{1p}(I)=y_{1p}(I)-2$ if $z_p(I)-y_{1p}(I)>0$, then $y_{1p}(I)=y_{1p}(I)+2$ set $z_p=2^{z'_p}$ Calculate $S$ as the sum of the components of $y_{2p}$ Find the position $I$ where $\mathrm{abs}[z_p(i)-y_{2p}(i)]$ is the highest if $z_p(I)-y_{2p}(I)<0$, then $y_{2p}(I)=y_{2p}(I)-2$ if $z_p(I)-y_{2p}(I)>0$, then $y_{2p}(I)=y_{2p}(I)+2$ $y_{2p}=y_{2p}+1.0$ Compute $e_{1p}=(X2(k)-y_{1p}(k))$ and $e_{2p}=(X2(k)-y_{2p}(k)$ if $e_{1p}>e_{2p}$ then the best lattice point is $y_{1p}$ otherwise the best lattice point is $y_{2p}$ (Equation 8)

Neighborhood search section 302 outputs the calculated neighborhood vector ($y_{1p}$ or $y_{2p}$ in equation 8) to multi-rate indexing section 303.

Multi-rate indexing section 303 performs multi-rate indexing on each subband using the neighborhood vector received from neighborhood search section 302 and the technique disclosed in Non-Patent Literature 1 and Non-Patent Literature 3, to generate index information indicating multi-rate indexing result in each subband.

Figure 4:
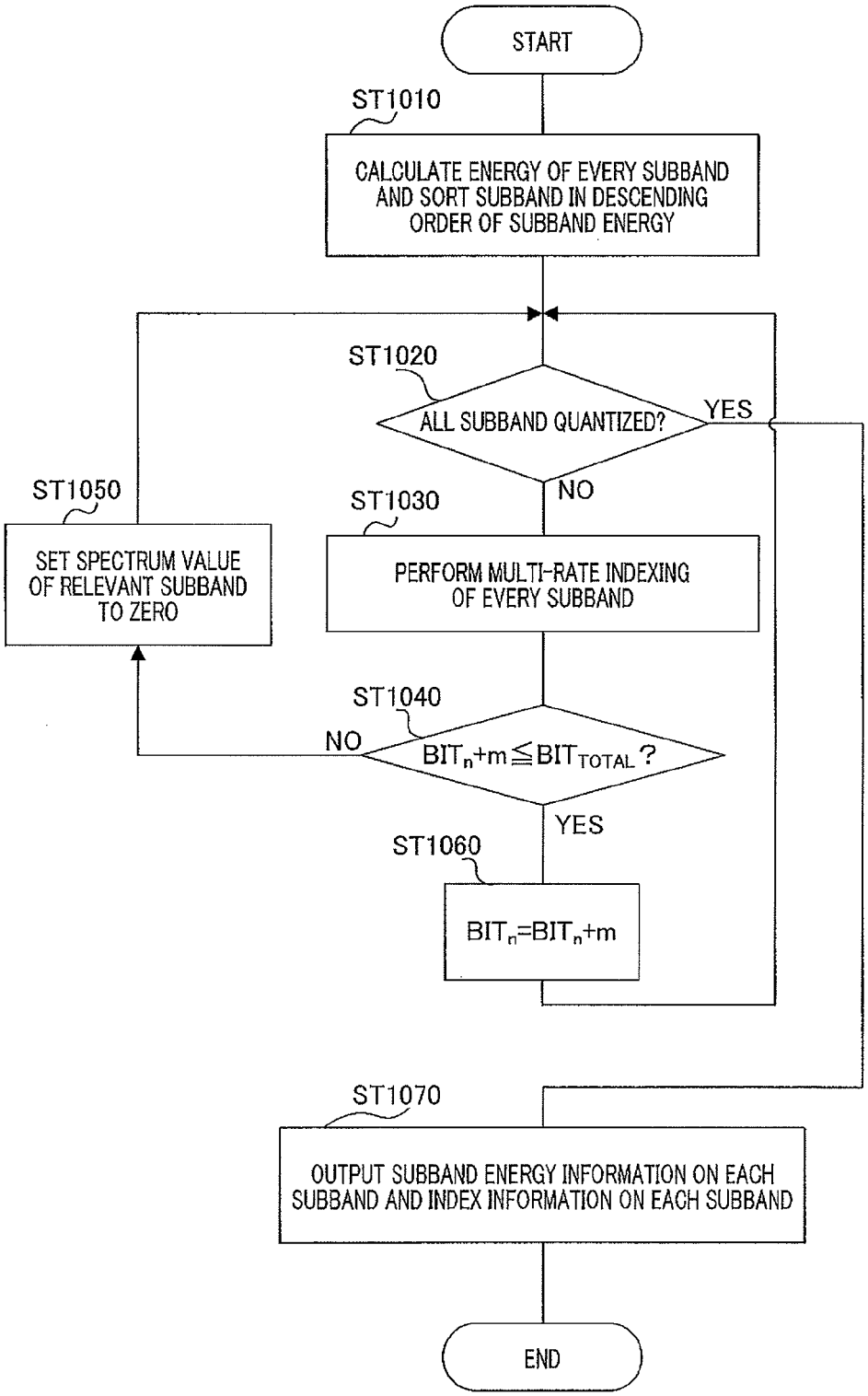
FIG. 4 is a flowchart showing a process in the multi-rate indexing section shown in FIG. 3.

FIG. 4 shows a processing flowchart of multi-rate indexing section 303. Hereinafter, a case where a coding process for the total number of bits assigned to layer 3 and layer 4 (herein, 4 kbps and 8 kbps are assigned to layer 3 and layer 4, respectively, and the total bit rate is 12 kbps, for example) is performed as with the AVQ coding section disclosed in Non-Patent Literature 1 is described.

In step (hereinafter, referred to as ST) 1010, multi-rate indexing section 303 calculates the energy of sub-spectrum $SS_p(k)$ every subband and sorts the calculated energies of subbands (i.e., a subband energy) in descending order of energy. Subband energy $E_p$ of each sub-spectrum is calculated from following equation 9.

[9]

$$E_p = \sum_{k=BS_p}^{BE_p} SS_p(k)^2 \quad \text{(Equation 9)}$$

In ST1020, multi-rate indexing section 303 determines whether or not sub-spectra $SS_p(k)$ of all subbands have been quantized. In multi-rate indexing section 303, the process proceeds to ST1070 in a case where sub-spectra $SS_p(k)$ of all subbands have been already quantized (ST1020: YES), and proceeds to ST1030 in a case where sub-spectra $SS_p(k)$ of all subbands have not been quantized (ST1020: NO).

In ST1030, multi-rate indexing section 303 performs multi-rate indexing (quantization) on sub-spectrum $SS_p(k)$ of each subband and generates index information indicating multi-rate indexing (quantization) result of sub-spectrum $SS_p(k)$ of each subband. Since Non-Patent Literature 3 discloses details of the multi-rate indexing process, the explanation thereof will be omitted.

In ST1040, multi-rate indexing section 303 determines whether or not total bits used for multi-rate indexing (quantization) in ST1030 exceed bits assigned to multi-rate indexing section 303. In ST1040 shown in FIG. 4, $BIT_n$ shows total bits used for the multi-rate indexing process in ST1030 from the start of the process to the current time; m shows the number of bits used for a multi-rate indexing process of a sub-spectrum of a subband to be currently quantized; and $BIT_{TOTAL}$ shows the number of bits assigned to multi-rate indexing section 303. In ST1040, the process proceeds to ST1060 when a value obtained by adding m to $BIT_n$ is less than or equal to $BIT_{TOTAL}$ (ST1040: YES) and proceeds to ST1050 when a value obtained by adding m to $BIT_n$ is greater than $BIT_{TOTAL}$ (ST1040: NO).

In ST1050, multi-rate indexing section 303 sets sub-spectrum value $SS_p(k)$ (a spectrum value) of a subband (the subband shown in FIG. 4) to be currently quantized to zero in accordance with following equation 10.

[10]

$$SS_p(k)=0(k=BS_p, \ldots, BE_p) \quad \text{(Equation 10)}$$

In ST1060, multi-rate indexing section 303 updates $BIT_n$ showing a total value of bits used for the multi-rate indexing process to ($BIT_n$+m).

In ST1070, multi-rate indexing section 303 outputs the subband energy information indicating the subband energy of each subband, which is calculated in ST1010, index information calculated in ST1030, and a coding bit rate assigned to multi-rate indexing section 303 to band selecting section 304 and ends the process.

Band selecting section 304 (FIG. 3) selects a specific subband group which is perceptually important (i.e., an important subband group), using the index information and the subband energy information which are received from multi-rate indexing section 303, and the coding bit rate assigned to multi-rate indexing section 303. As the coding bit rate assigned to multi-rate indexing section 303, the present embodiment describes an example of 4 kbps assigned to layer 3. A method of selecting a band in band selecting section 304 will be described hereinafter.

Band selecting section 304 selects a specific subband group having the highest subband energy indicated in the subband energy information as an important subband group. The important subband group is selected under the condition that the total number of bits used for quantizing the sub-spectrum of each subband, which is included in the index information (in other words, the number of coding bits assigned to each subband) is less than or equal to a preset coding bit rate (i.e., the number of bits, herein, or a coding bit rate (4 kbps) assigned to layer 3).

In other words, band selecting section 304 determines a specific subband group which is perceptually important (i.e., an important subband group) in layer 3 and layer 4 (coding layers performing coding processes together) among a plurality of subbands, using the number of coding bits used for multi-rate indexing for each of a plurality of subbands (the number of coding bits assigned to each of the plurality of subbands) and a subband energy of each of the plurality of subbands. The specific subband group includes subbands in a range where the total number of coding bits is less than or equal to a preset value (herein, a coding bit rate assigned to layer 3) and subbands in a range where the total of the subband energy is the highest. However, only a set of continuous subbands is treated as an important subband group target in a case where subbands are arranged in ascending order of frequency (descending order is possible as well).

Figure 5:
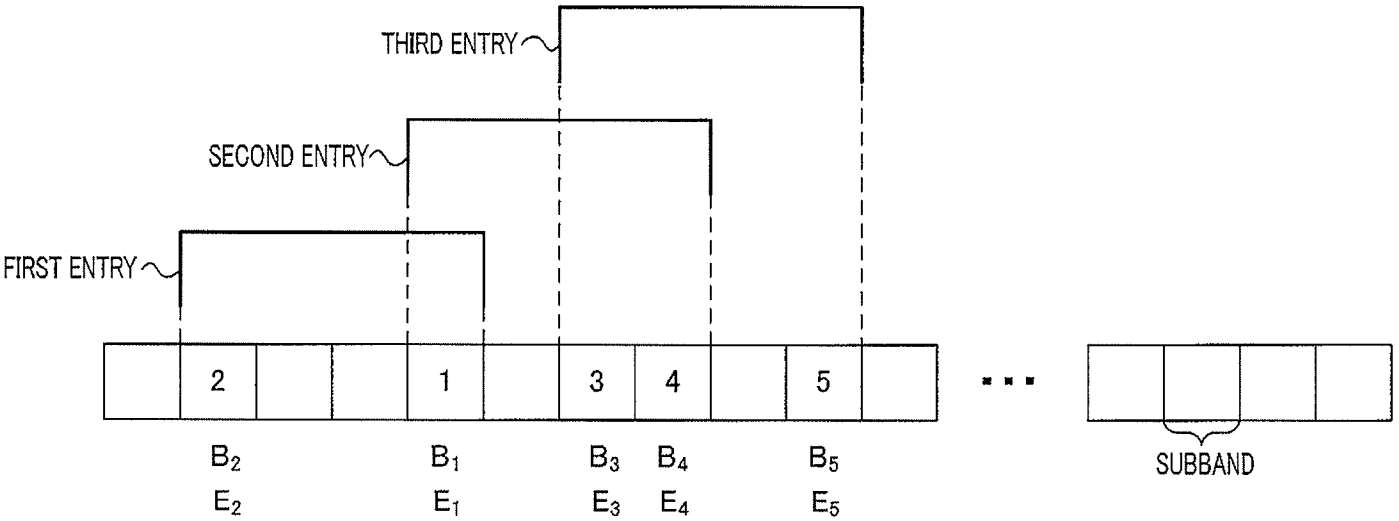
FIG. 5 is a diagram showing an outline of a process in the band selecting section shown in FIG. 3.

FIG. 5 is an outline of a process in band selecting section 304. Each block (square) shown in FIG. 5 refers to one subband. In FIG. 5, the value in each block represents the order of subband energy (i.e., as the number is small, the subband energy is high); value $B_n$ under each of the subbands represents the number of bits used for quantization of a sub-spectrum of each of the subbands; and $E_n$ represents a subband energy. Although FIG. 5 only shows up to the fifth subband in sequence from higher subband energy, the same is also considered possible with respect to the sixth subband onward.

In a method used in the multi-rate indexing section disclosed in Non-Patent Literature 1, several subbands in a higher frequency are not encoded nor assigned a bit when a coding bit is not sufficient. Accordingly, the number of subbands shown in FIG. 5 may vary every frame.

The nth entry (n=1, 2, 3, . . . ) shown in FIG. 5 refers to a selection candidate of an important subband group (a selection range of a subband). As shown in FIG. 5, band selecting section 304 searches entries in which the number of bits used for a group of continuous subbands is less than or equal to the number of coding bits (equivalent to 4 kbps) in layer 3, for an entry having a total subband energy of the highest level. Band selecting section 304 outputs the position of the beginning subband in the searched entry (i.e., an important subband group) to index information adjusting section 305 as band coded information. In FIG. 5, when the second entry is selected as the important subband group, for example, an index of a subband having the order "1" in the subband energy (in FIG. 5, this subband is the fifth from the top subband, therefore the index is 4) corresponds to band coded information.

The important subband group targets continuous subbands, and therefore, a candidate entry in the lowest frequency is "a candidate entry including the top subband of continuous subbands as the first subband of the candidate entry," and a candidate entry in the highest frequency is "a candidate entry including the end subband of continuous subbands as the last subband of the candidate entry" among candidate entries. In other words, a candidate entry which protrudes from the borders of the top subband or the end subband is ignored.

Band selecting section 304 outputs the index information received from multi-rate indexing section 303 to index information adjusting section 305.

Index information adjusting section 305 performs a rearrangement process on the index information using the index information and the band coded information which are received from band selecting section 304. Specifically, index information adjusting section 305 performs the rearrangement process on the index information so as to locate part corresponding to an important subband group including a subband indicated by the band coded information at the top, and locate the remaining subband index information after the top among all subband index information parts.

Figure 6:
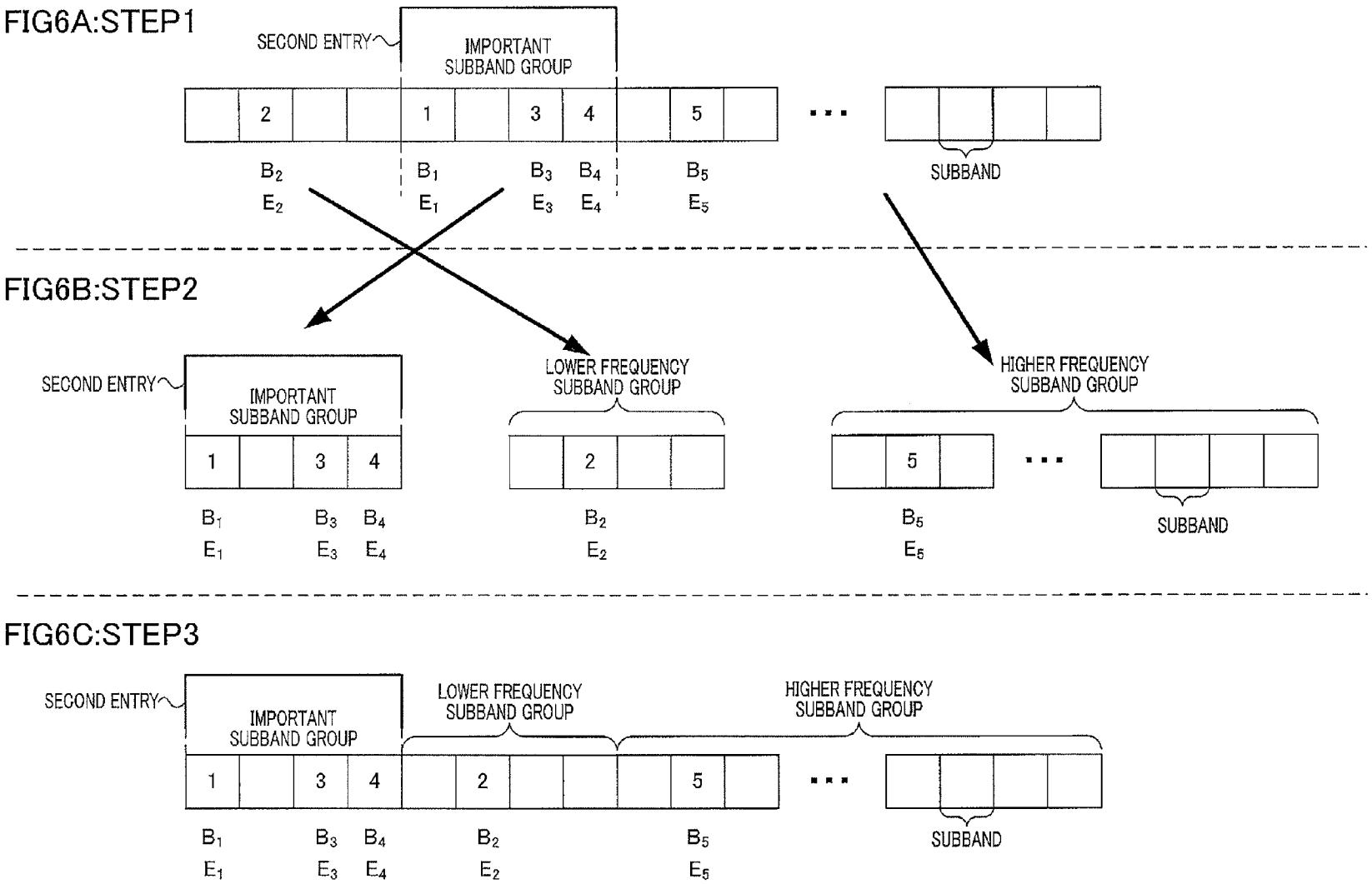
FIG. 6 is a diagram showing an outline of a process in index information adjusting section shown in FIG. 3.

FIG. 6 is a conceptual diagram of the rearrangement process in index information adjusting section 305. Index information adjusting section 305 can determine a subband contained in the above mentioned important subband group from the band coded information and the number of coding bits used for quantization of index information, as with band selecting section 304. In FIG. 6, a case will be described where a subband group of the second entry is calculated as an important subband group in band selecting section 304.

In step 1 shown in FIG. 6A, index information adjusting section 305 first calculates an important subband group with respect to index information sorted in ascending order of frequency, using band coded information. The important subband group selected in index information adjusting section 305 is the same as the important subband group selected in band selecting section 304.

In step 2 shown in FIG. 6B, index information adjusting section 305 divides subbands into the important subband group selected in step 1, subbands in a lower frequency than the important subband group (a lower frequency subband group), and subbands in a higher frequency than the important subband group (a higher frequency subband group).

In step 3 shown in FIG. 6C, index information adjusting section 305 rearranges the subbands such that the important subband group selected in step 1 is at the top of the subbands and the subbands other than the important subband group follows the important subband group while maintaining the ascending order of frequency. In other words, index information adjusting section 305 rearranges the subbands, in sequence of "the important subband group," "the lower frequency subband group," and "the higher frequency subband group" from a lower frequency as shown in FIG. 6.

The rearrangement process for index information in index information adjusting section 305 has been described above. Index information adjusting section 305 then outputs the rearranged index information and the band coded information to multiplexing section 306.

Multiplexing section 306 multiplexes global gain g received from global gain calculating section 301 with the index information and the band coded information which are received from index information adjusting section 305, and generates the third and fourth layer coded information. Multiplexing section 306 outputs the generated third and fourth layer coded information to third and fourth layer decoding section 209 and coded information integrating section 212.

A process in third and fourth layer coding section 208 has been described above.

Figure 7:
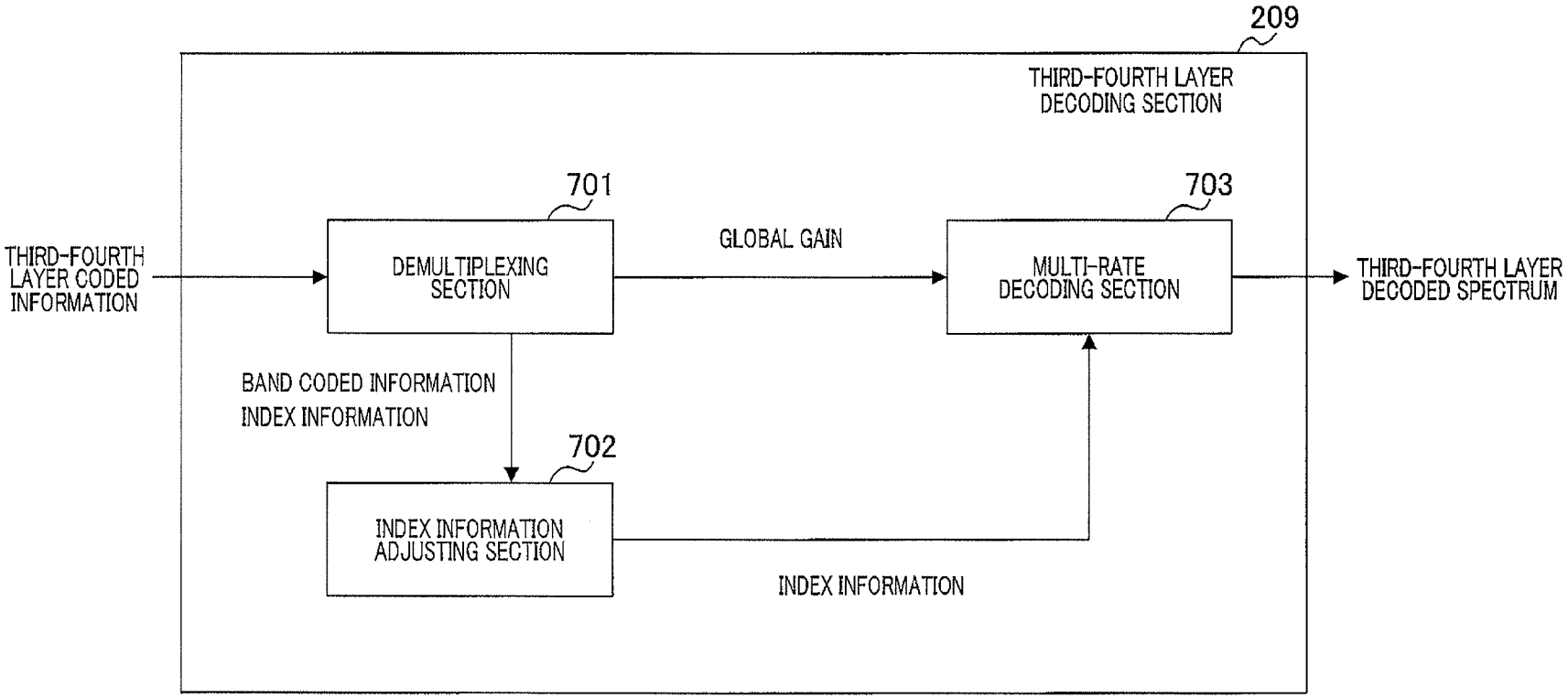
FIG. 7 is a block diagram showing a main configuration inside the third and fourth layer decoding section shown in FIG. 2.

FIG. 7 is a block diagram showing a main configuration inside third and fourth layer decoding section 209 shown in FIG. 2. Third and fourth layer decoding section 209 is mainly formed of demultiplexing section 701, index information adjusting section 702, and multi-rate decoding section 703.

Demultiplexing section 701 demultiplexes the third and fourth layer coded information received from third and fourth layer coding section 208 into index information, band coded information, and a global gain. Demultiplexing section 701 outputs the index information and the band coded information to index information adjusting section 702 and outputs the global gain to multi-rate decoding section 703.

Index information adjusting section 702 performs a rearrangement process on the index information using the index information and the band coded information which are outputted from demultiplexing section 701. Specifically, index information adjusting section 702 performs the rearrangement process on the index information using the band coded information. Index information adjusting section 702 performs a process which is a reversal of a process in index information adjusting section 305 (FIG. 3) in third and fourth layer coding section 208. A process in index information adjusting section 702 will be described.

Figure 8:
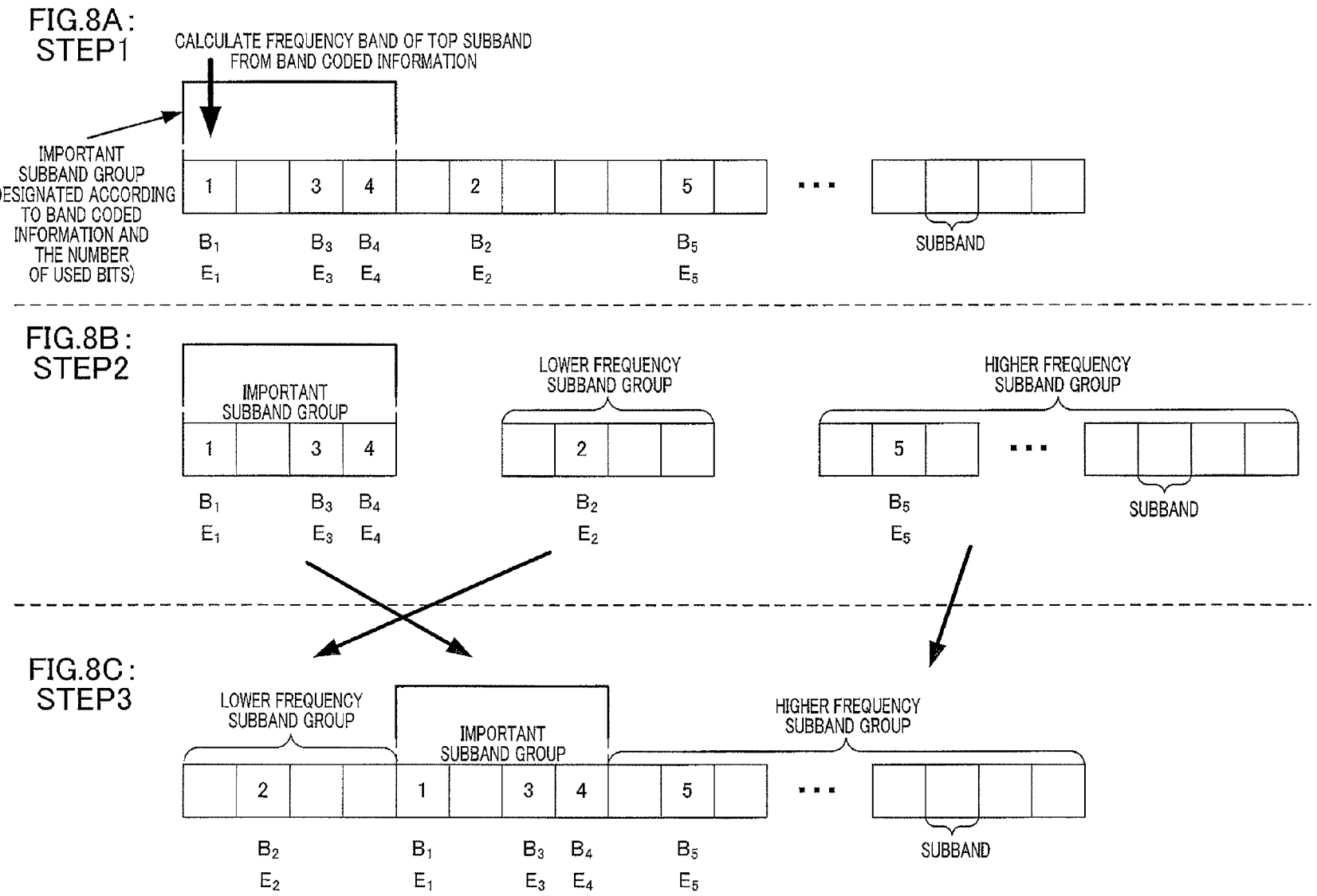
FIG. 8 is a diagram showing an outline of a process in the index information adjusting section shown in FIG. 7.

FIG. 8 is a conceptual diagram of a process in index information adjusting section 702. The notation in FIG. 8 is similar to the notation in FIG. 6. In a decoding process (FIG. 8) in third and fourth layer decoding section 209, although the order of subband energy (the number indicating the order from the highest subband energy) is not particularly required in FIG. 8, FIG. 8 shows the order to allow easier comparison with the coding process in third and fourth layer coding section 208.

In step 1 shown in FIG. 8A, index information adjusting section 702 first decodes the band coded information outputted from demultiplexing section 701 and calculates the frequency band of the top subband of the index information outputted from demultiplexing section 701 (in other words, index information adjusting section 702 determines which band in the frequency domain the top subband corresponds to). Index information adjusting section 702 then adds the number of coding bits used in each subband from the top subband, searches for a subband position at which a total number of bits does not exceed the predetermined number of bits and is largest, and determines an important subband group. The predetermined number of bits refers to the number of coding bits (i.e. corresponding to 4 kbps) in layer 3. FIG. 8A shows a case of defining the top to the fourth subbands as the important subband group.

In step 2 shown in FIG. 8B, index information adjusting section 702 determines subbands in a lower band in the frequency domain than the important subband group (i.e., a lower frequency subband group), among subbands which follow the important subband group calculated in step 1. This can be calculated from the frequency band of the top subband calculated in step 1. In other words, index information adjusting section 702 may calculate how many more subbands are present in the lower frequency than the top subband, based on the frequency band of the top subband in step 1, and thus determine the number of subbands calculated from the subbands which follow the important subband group as the lower frequency subband group. The method of dividing subbands used herein is similar to the dividing method used in third and fourth layer coding section 208. Index information adjusting section 702 defines the part which follows the lower frequency subband group determined by the above mentioned method, as subbands in a higher band than the important subband group in the frequency domain (i.e., a higher frequency subband group).

In step 3 shown in FIG. 8C, index information adjusting section 702 then rearranges the important subband group, the lower frequency subband group, and the higher frequency subband group which are determined in step 1 and step 2 in sequence of "the lower frequency subband group," "the important subband group," and "the higher frequency subband group" from a lower frequency.

Index information adjusting section 702 outputs the index information rearranged by the above mentioned process to multi-rate decoding section 703.

Multi-rate decoding section 703 decodes the global gain received from demultiplexing section 701 and the index information received from index information adjusting section 702, and calculates the third and fourth layer decoded spectrum. Multi-rate decoding section 703 then outputs the calculated third and fourth layer decoded spectrum to adding section 210. Because Non-Patent Literature 1 discloses a process in multi-rate decoding section 703 in detail, the description thereof will be omitted.

A process in coding apparatus 101 has been described above.

Figure 9:
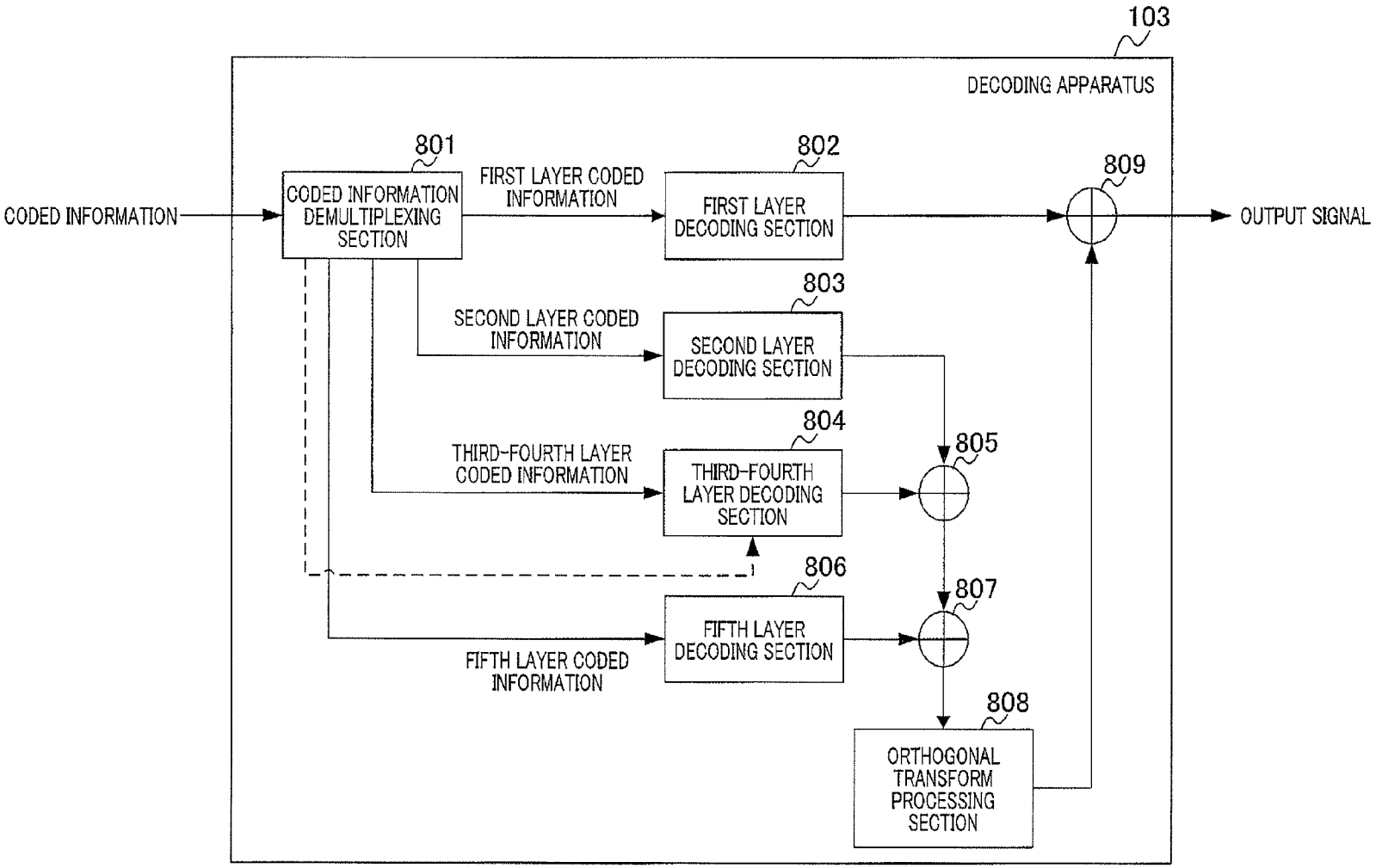
FIG. 9 is a block diagram showing a main configuration inside the decoding apparatus shown in FIG. 1.

FIG. 9 is a block diagram showing a main configuration inside decoding apparatus 103 shown in FIG. 1. Decoding apparatus 103 is a layer decoding apparatus including five decoding layers, for example. Hereinafter, each of the five decoding layers is referred to as the first layer, the second layer, the third layer, the fourth layer, and the fifth layer in ascending order of bit rate as with coding apparatus 101. Third and fourth layer decoding section 804 performs decoding processes in the third layer and the fourth layer together in association with coding apparatus 101.

Coded information demultiplexing section 801 receives coded information transmitted from coding apparatus 101 through transmission channel 102, demultiplexes the received coded information into coded information for each layer, and outputs each of the coded information to the corresponding decoding section configured to perform the decoding process. Specifically, coded information demultiplexing section 801 outputs the first layer coded information included in the coded information to first layer decoding section 802, outputs the second layer coded information included in the coded information to second layer decoding section 803, outputs the third and fourth layer coded information included in the coded information to third and fourth layer decoding section 804, and outputs the fifth layer coded information included in the coded information to the fifth layer decoding section 806. When the coded information does not include coded information on a certain layer, coded information demultiplexing section 801 does not output anything to a decoding section of the layer. Coded information demultiplexing section 801 controls a decoding operation of the third and fourth decoding layer. Specifically, coded information demultiplexing section 801 controls the decoding operation of the third and fourth decoding layer into "a normal mode (L3-L4 mode)" when the coded information includes the third and fourth layer coded information and when the third and fourth coded information is the total number of coding bits of the third layer and the fourth layer. Coded information demultiplexing section 801 controls the decoding operation of the third and fourth decoding layer to "a low bit rate mode (L3 mode)" when the coded information includes the third and fourth layer coded information and when the third and fourth coded information is only the number of coding bits of the third layer. FIG. 9 uses a broken line to show the control operation in coded information demultiplexing section 801.

First layer decoding section 802 decodes the first layer coded information received from coded information demultiplexing section 801 using a CELP speech decoding method to generate the first layer decoded signal and outputs the generated first layer decoded signal to adding section 809.

Second layer decoding section 803 decodes the second layer coded information received from coded information demultiplexing section 801 and outputs the acquired second layer decoded spectrum X2"($k$) to adding section 805. Because Non-Patent Literature 1 discloses the details of a process in second layer decoding section 803, the description thereof will be omitted from the present embodiment.

Third and fourth layer decoding section 804 decodes the third and fourth layer coded information received from coded information demultiplexing section 801 and outputs the acquired third and fourth layer decoded spectrum X34"($k$) to adding section 805. Coded information demultiplexing section 801 controls the decoding operation of third and fourth layer decoding section 804. A process in third and fourth layer decoding section 804 in detail will be described hereinafter.

Adding section 805 receives second layer decoded spectrum X2"($k$) from second layer decoding section 803 and receives third and fourth layer decoded spectrum X34"($k$) from third and fourth layer decoding section 804. Adding section 805 adds received second layer decoded spectrum X2"($k$) and third and fourth layer decoded spectrum X34"($k$), and outputs the added spectrum to adding section 807 as first added spectrum Xadd1"($k$).

Fifth layer decoding section 806 decodes the fifth layer coded information received from coded information demultiplexing section 801 and outputs the acquired fifth layer decoded spectrum X5"($k$) to adding section 807. Because Non-Patent Literature 1 discloses the details of fifth layer decoding section 806, the description thereof will be omitted from the present embodiment.

Adding section 807 receives first added spectrum Xadd1($k$) from adding section 805 and receives fifth layer decoded spectrum X5"($k$) from fifth layer decoding section 806. Adding section 807 adds received first added spectrum Xadd1"($k$) and fifth layer decoded spectrum X5"($k$) and outputs the added spectrum to orthogonal transform processing section 808 as second added spectrum Xadd2($k$).

Orthogonal transform processing section 808 first initializes built-in buffer buf"(k) to a value of "0" in accordance with following equation 11.

[11]

$$\text{buf}'(k)=0(k=0,\ldots,N-1) \quad \text{(Equation 11)}$$

Next, orthogonal transform processing section 808 receives second added spectrum Xadd2($k$) and acquires second added decoded signal y"(n) in accordance with following equation 12.

[12]

$$y''(n)=\frac{2}{N}\sum_{n=0}^{2N-1} X6(k)\cos\left[\frac{(2n+1+N)(2k+1)\pi}{4N}\right] \quad \text{(Equation 12)}$$

$$(n=0,\ldots,N-1)$$

In equation 12, X6($k$) is a vector obtained by combining second added spectrum Xadd2($k$) with buffer buf'(k), and is calculated from following equation 13.

[13]

$$X6(k)=\begin{cases} buf'(k) & (k=0,\ldots N-1) \\ Xadd2(k) & (k=N,\ldots 2N-1) \end{cases} \quad \text{(Equation 13)}$$

Orthogonal transform processing section 808 updates buffer buf'(k) in accordance with following equation 14.

[14]

$$\text{buf}'(k)=Xadd2(k)(k=0,\ldots N-1) \quad \text{(Equation 14)}$$

Orthogonal transform processing section 808 outputs second added decoded signal y"(n) to adding section 809.

Adding section 809 receives the first layer decoded signal from first layer decoding section 802 and receives the second added decoded signal from orthogonal transform processing section 808. Adding section 809 adds the received first layer decoded signal and second added decoded signal and outputs the added signal as an output signal.

Figure 10:
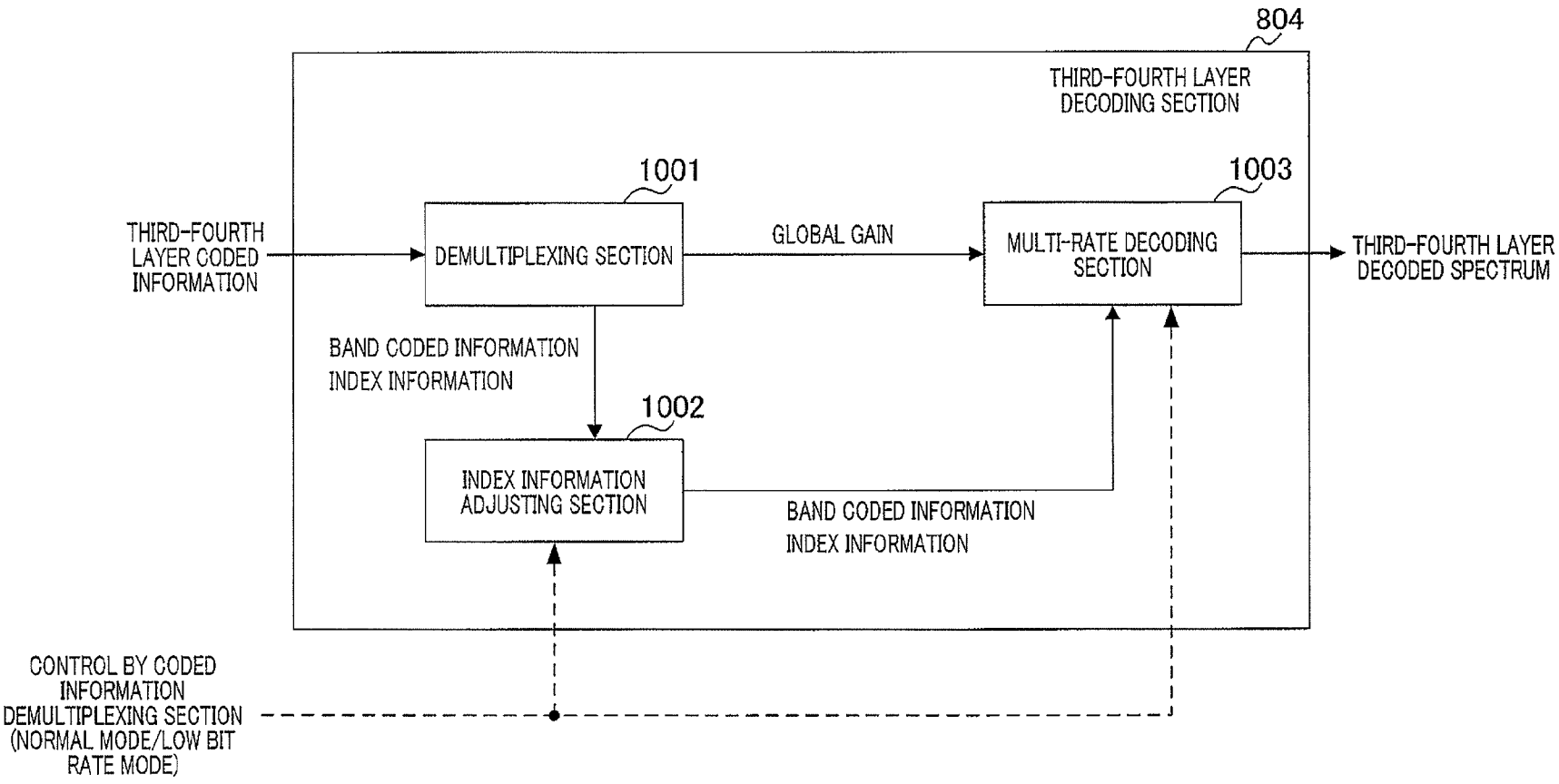
FIG. 10 is a block diagram showing a main configuration inside the third and fourth layer decoding section shown in FIG. 9.

FIG. 10 is a block diagram showing a main configuration inside third and fourth layer decoding section 804 shown in FIG. 9. Third and fourth layer decoding section 804 is mainly formed of demultiplexing section 1001, index information adjusting section 1002, and multi-rate decoding section 1003.

Demultiplexing section 1001 demultiplexes the third and fourth layer coded information outputted from coded information demultiplexing section 801 into index information, band coded information, and a global gain. Demultiplexing section 1001 then outputs the index information and the band coded information to index information adjusting section 1002 and outputs the global gain to multi-rate decoding section 1003.

Index information adjusting section 1002 performs a rearrangement process on the index information using the index information and the band coded information, which are outputted from demultiplexing section 1001. Demultiplexing section 801 (FIG. 9) controls the process performed by index information adjusting section 1002. A method of controlling the process performed by index information adjusting section 1002 will be described.

Index information adjusting section 1002 performs a process which is a reversal of the process performed by index information adjusting section 702 in coding apparatus 101 when the control by coded information demultiplexing section 801 is "a normal mode (L3-L4 mode)." In other words, when a decoding process is performed in layer 3 and layer 4, index information adjusting section 1002 performs a rearrangement process which is the reversal of the process performed by index information adjusting section 702, on the index information which is rearranged such that a part corresponding to an important subband group is located at the top of the index information in index information adjusting section 702 in coding apparatus 101. Detailed explanation of the rearrangement process in index information adjusting section 1002 will be omitted.

On the other hand, the third and fourth layer coded information includes index information on the number of bits assigned to the third layer, in other words, it includes index information on the important subband group when the control by coded information demultiplexing section 801 is "a low bit rate mode (L3 mode)." At that time, index information adjusting section 1002 outputs, to multi-rate decoding section 1003, index information and band coded information indicating which band the frequency of the top subband of the important subband group corresponds to. That is to say, when a decoding process is performed in only layer 3, index information adjusting section 1002 does not perform the rearrangement process on the index information which is rearranged such that a part corresponding to an important subband group is located at the top of the index information in index information adjusting section 702 in coding apparatus 101.

Multi-rate decoding section 1003 decodes the global gain received from demultiplexing section 1001 and the index information and the band coded information received from index information adjusting section 1002 and calculates the third and fourth layer decoded spectrum. Coded information demultiplexing section 801 controls a process in multi-rate decoding section 1003. A method of controlling the process in multi-rate decoding section 1003 will be described.

Multi-rate decoding section 1003 performs a similar process to the process in multi-rate decoding section 703 in coding apparatus 101 when the control by coded information demultiplexing section 801 is "a normal mode (L3-L4 mode)." The explanation thereof will be omitted. Multi-rate decoding section 1003 need not receive the band coded information from index information adjusting section 1002 at this time.

Multi-rate decoding section 1003 decodes index information on the frequency band determined from the received band coded information and calculates the third and fourth decoded spectrum when the control by coded information demultiplexing section 801 is "a low bit rate mode (L3 mode)." Specifically, multi-rate decoding section 1003 decodes index information sequentially from the frequency corresponding to a top subband to higher frequency in the frequency domain by associating the top subband included in the index information with a frequency band indicated by band coded information. In this process, multi-rate decoding section 1003 sets a value of the third and fourth decoded spectrum to zero in a lower frequency than the frequency band indicated by the band coded information. Similarly, multi-rate decoding section 1003 sets a value of the third and fourth decoded spectrum to zero in a higher frequency than a frequency band corresponding to the index information. Specifically, multi-rate decoding section 1003 decodes only index information corresponding to the number of bits assigned to the third layer, which is included in the third and fourth layer coded information (i.e., the index information on the important subband group) as a spectrum of the corresponding frequency band.

In view of the above, multi-rate decoding section 1003 decodes only the part corresponding to the important subband group indicated by the band coded information among the index information and generates a decoded signal (the third and fourth layer decoded spectrum) when multi-rate decoding section 1003 performs a decoding process in only part of a plurality of coding layers. Multi-rate decoding section 1003 then outputs the calculated third and fourth layer decoded spectrum to adding section 805.

A process in decoding apparatus 103 has been described above.

As described above, coding apparatus 101 specifies a perceptually important subband group and generates band coded information in a plurality of coding layers which perform coding processes together (layer 3 and layer 4). This permits decoding apparatus 103 to distinguish part corresponding to the coded parameter of layer 3 from the transmitted coded parameter (index information). Accordingly, decoding apparatus 103 can perform a decoding process by selecting a specific part which is perceptually important in the coded parameter obtained by performing coding processes in layer 3 and layer 4 together, even when performing a decoding process in only part of coding layers which perform coding processes together (a case of performing decoding at bit rates from layer 1 to layer 3 (12 kbps)), for example. Accordingly, it is possible to improve the quality of a decoded signal in decoding apparatus 103 even when AVQ parameters in all layers are not decoded.

Coding apparatus 101 rearranges index information such that part corresponding to an important subband group among index information is located at a top of the index information. Accordingly, decoding apparatus 103 may decode a part corresponding to a coding layer which is a target for decoding in sequence from the top of the index information when performing a decoding process in only part of coding layers performing coding processes together. Subsequently, decoding apparatus 103 can perform a decoding process with a small amount of calculation when performing a decoding process in only part of coding layers which perform coding processes together.

The present embodiment partially selects a specific coded parameter which is perceptually important in a coding apparatus and reflects the degree of the perceptual importance on a coded parameter, in a configuration for applying an AVQ technique having a plurality of coding layers to a scalable coding scheme. Consequently, improving the quality of a decoded signal is possible even without decoding AVQ parameters in all layers. According to the present embodiment, it is possible to perform a coding process taking into account the degree of perceptual importance and perform a coded parameter (coded information) generating process, which allows the quality of a decoded signal to be improved.

Embodiment 2

Whereas Embodiment 1 has described a case where an AVQ coding section is formed of a plurality of coding layers (a case of scalable coding), the present embodiment describes a configuration for applying the present invention to a case where the AVQ coding section employs a multi-rate coding scheme.

A communication system according to Embodiment 2 (not shown) is basically similar to the communication system shown in FIG. 1, but differs from coding apparatus 101 of the communication system of FIG. 1 with respect to a part of the configuration and operation of a coding apparatus and a part of the configuration and the operation of a decoding apparatus. Hereinafter, the present embodiment will be described by assigning reference numeral "111" to a coding apparatus and assigning reference numeral "113" to a decoding apparatus in a communication system according to the present embodiment.

Figure 11:
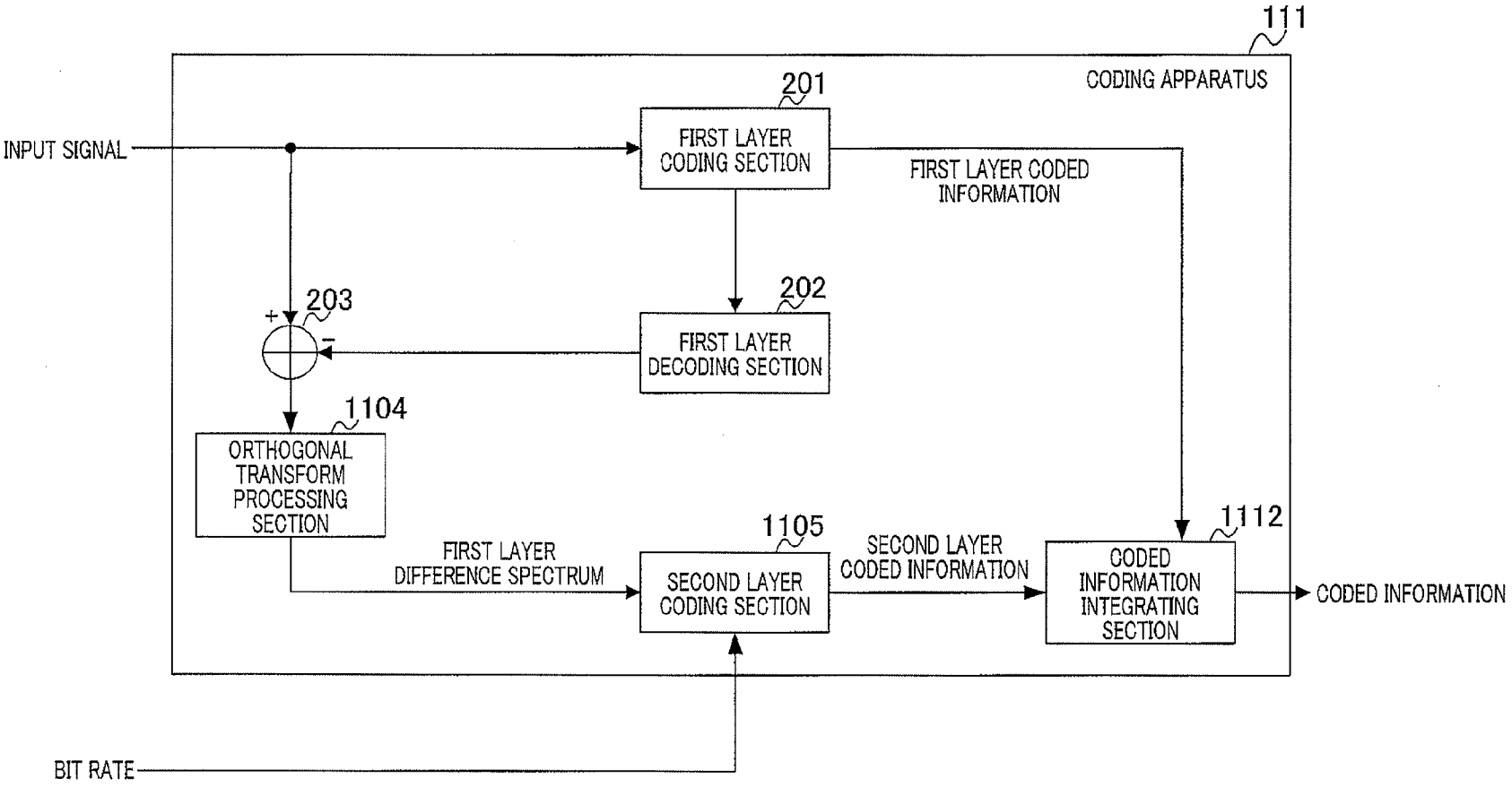
FIG. 11 is a block diagram showing a main configuration inside the coding apparatus according to Embodiment 2 of the present invention.

FIG. 11 is a block diagram showing a main configuration inside coding apparatus 111. Coding apparatus 111 is a layer coding apparatus including two coding layers, for example. Hereinafter, the two coding layers are respectively referred to as the first layer and the second layer in ascending order of bit rate. The second layer employs a multi-rate coding scheme.

Coding apparatus 111 is mainly formed of first layer coding section 201, first layer decoding section 202, adding section 203, orthogonal transform processing section 1104, second layer coding section 1105, and coded information integrating section 1112. First layer coding section 201, first layer decoding section 202, and adding section 203 have a configuration similar to the configuration described in Embodiment 1 (FIG. 2), and therefore the same reference numerals are assigned thereto and the explanation thereof will be omitted.

Orthogonal transform processing section 1104 performs an orthogonal transformation on the first layer difference signal outputted from adding section 203 and calculates the first layer difference spectrum which is a component in the frequency domain. Orthogonal transform processing section 1104 outputs the calculated first layer difference spectrum to second layer coding section 1105. An orthogonal transformation process in orthogonal transform processing section 1104 is similar to the method described above (for example, orthogonal transform processing section 204), and therefore the explanation thereof will be omitted.

Second layer coding section 1105 receives as input the first layer difference spectrum outputted from orthogonal transform processing section 1104. Second layer coding section 1105 receives as input a bit rate in encoding from outside. Second layer coding section 1105 encodes the first layer difference spectrum based on the bit rate and calculates the second layer coded information. Second layer coding section 1105 then outputs the second layer coded information to coded information integrating section 1112. Details of a process in second layer coding section 1105 will be described hereinafter.

Coded information integrating section 1112 integrates the first layer coded information received from first layer coding section 201 and the second layer coded information received from second layer coding section 1105. Coded information integrating section 1112 adds a transmission error code to the integrated information source code as necessary and outputs the resultant code to transmission channel 102 as coded information.

Figure 12:
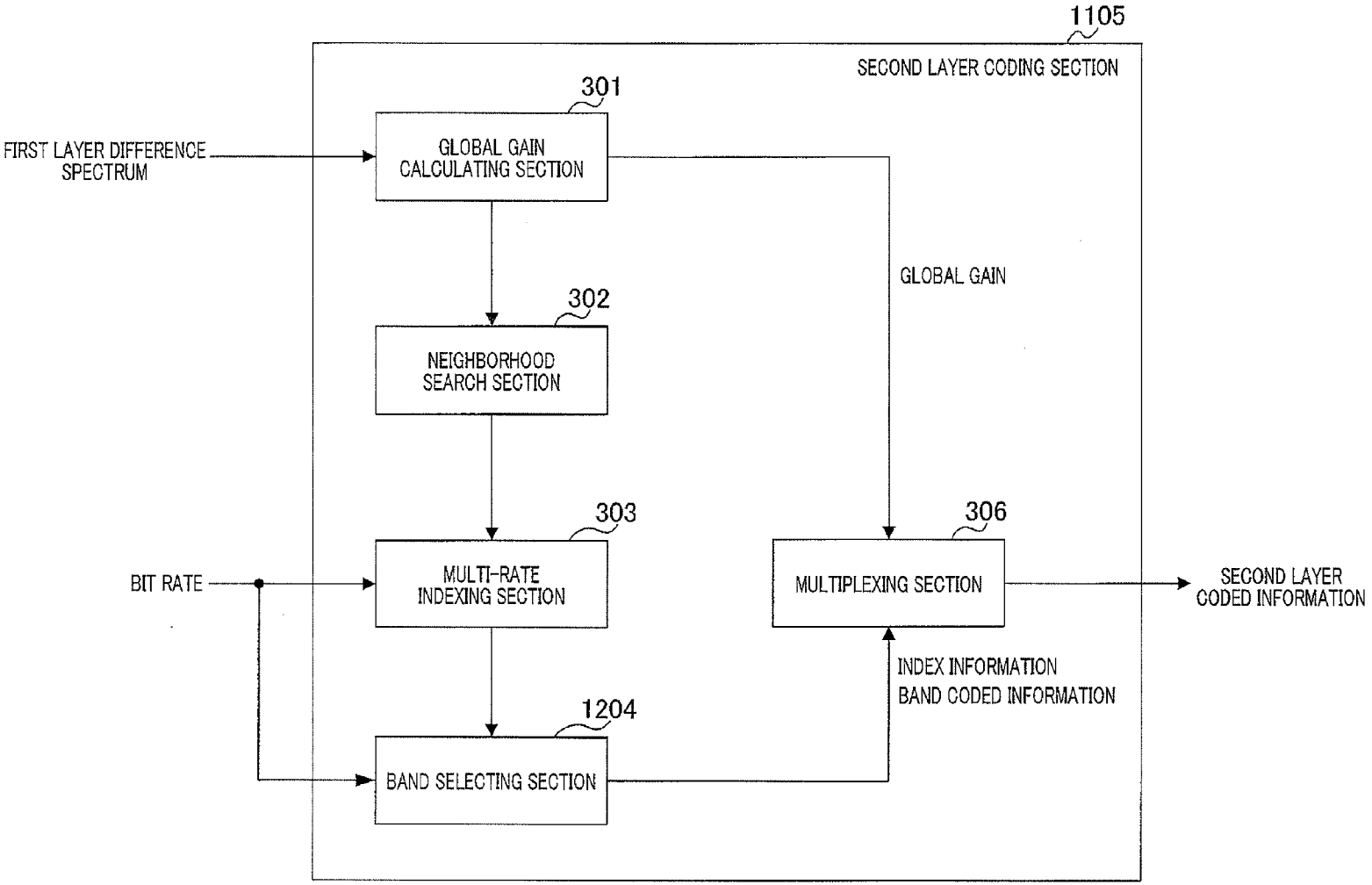
FIG. 12 is a block diagram showing a main configuration inside the second layer coding section shown in FIG. 11.

FIG. 12 is a block diagram showing a main configuration inside second layer coding section 1105. Second layer coding section 1105 is mainly formed of global gain calculating section 301, neighborhood search section 302, multi-rate indexing section 303, band selecting section 1204, and multiplexing section 306. Each section performs the following operations. Because global gain calculating section 301, neighborhood search section 302, multi-rate indexing section 303, and multiplexing section 306 have the same configuration as the configuration described in Embodiment 1 (FIG. 3), the same reference numerals are assigned thereto and the description thereof will be omitted. However, the configuration of multi-rate indexing section 303 shown in FIG. 12 differs from the configuration described in Embodiment 1 only in that $BIT_{TOTAL}$ is the number of bits corresponding to a bit rate received from outside in encoding.

[0117] Band selecting section 1204 selects a specific subband group which is perceptually important (i.e., an important subband group) using index information and subband energy information which are received from multi-rate indexing section 303 and a bit rate received from the outside in encoding. An example case of using 4 kbps or 8 kbps for the bit rate received from outside will be described. A method of selecting a band in band selecting section 1204 will be described below.

Band selecting section 1204 selects a subband group having the highest subband energy information (i.e., an important subband group) on the condition that a total number of bits used for quantization of a sub-spectrum of each subband that is included in the index information is equal to or less than the bit rate (i.e., the number of bits) received from outside. In other words, band selecting section 1204 selects a specific subband group which is perceptually important (an important subband group) among a plurality of subbands, using coding bits assigned to each of a plurality of subbands in multi-rate indexing and a subband energy of each of the plurality of subbands, as with band selecting section 304 in Embodiment 1. The specific subband group includes subbands in a range where the total number of coding bits is less than or equal to a preset value (hereinafter, referred to as a coding bit rate received from the outside) and subbands in a range where the total of the subband energy is the highest. However, only a set of continuous subbands is treated as an important subband group target in a case where subbands are arranged in ascending order of frequency (descending order is also possible). A method of selecting an important subband group in band selecting section 1204 is the same as the method described in Embodiment 1 (band selecting section 304) and therefore, the explanation thereof will be omitted. Band selecting section 1204 outputs band coded information indicating a frequency band of a beginning subband (a top subband) of the selected important subband group to multiplexing section 306. Band selecting section 1204 extracts only index information corresponding to the important subband group and outputs this to multiplexing section 306 as new index information.

In other words, band selecting section 1204 in the present embodiment differs from band selecting section 304 described in Embodiment 1 in "searching for the important subband group according to a bit rate received from outside" and "outputting only index information corresponding to the important subband group to multiplexing section 306."

A process in second layer coding section 1105 has been described.

Figure 13:
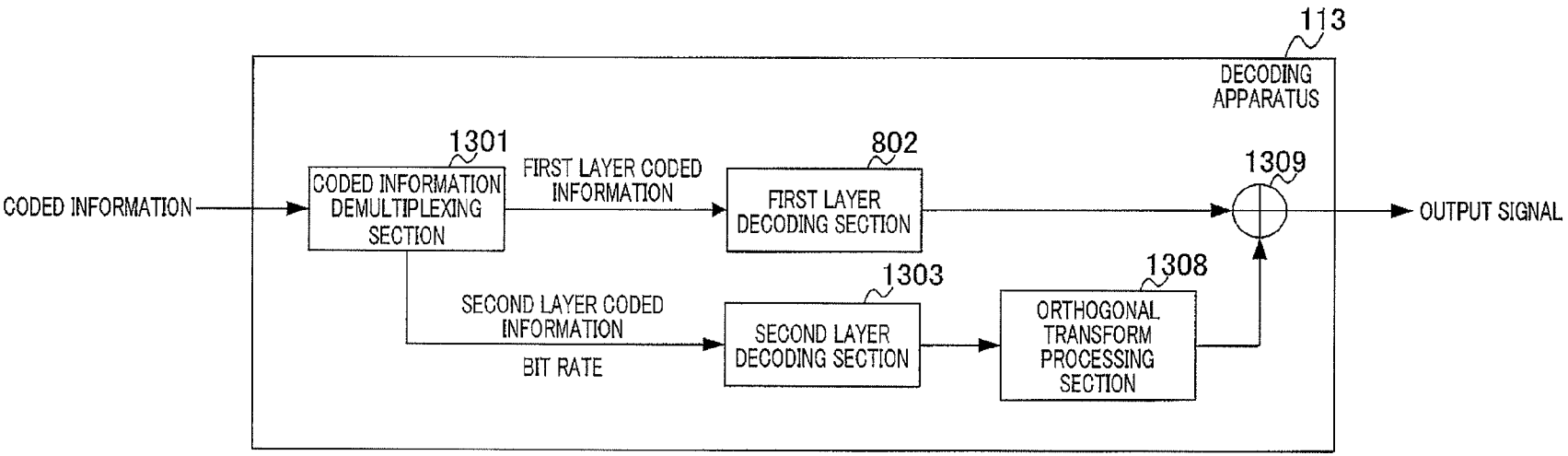
FIG. 13 is a block diagram showing a main configuration inside the decoding apparatus according to Embodiment 2 of the present invention.

FIG. 13 is a block diagram showing a main configuration inside decoding apparatus 113 according to the present embodiment. Decoding apparatus 113 is a layer decoding apparatus including two decoding layers as an example. Hereinafter, the two coding layers are respectively referred to as the first layer and the second layer in ascending order of bit rate as with coding apparatus 111. The second layer decoding section performs a multi-rate decoding process in association with coding apparatus 101.

As shown in FIG. 13, decoding apparatus 113 is mainly formed of coded information demultiplexing section 1301, first layer decoding section 802, second layer decoding section 1303, orthogonal transform processing section 1308, and adding section 1309. First layer decoding section 802 has the same configuration described in Embodiment 1 (FIG. 9), and therefore the same reference numerals are assigned thereto and the explanation thereof will be omitted.

Coded information demultiplexing section 1301 receives coded information transmitted from coding apparatus 111 through transmission channel 102, demultiplexes the received coded information into coded information for each layer, and outputs each of the coded information to the corresponding decoding section configured to perform the decoding process. Specifically, coded information demultiplexing section 1301 outputs the first layer coded information included in the coded information to first layer decoding section 802, and outputs the second layer coded information included in the coded information to second layer decoding section 1303.

Second layer decoding section 1303 decodes the second layer coded information received from coded information demultiplexing section 1301 and outputs acquired second layer decoded spectrum X2"(*k*) to orthogonal transform processing section 1308. Details of a process in second layer decoding section 1303 will be described hereinafter.

Orthogonal transform processing section 1308 performs an orthogonal transformation on the second layer decoded spectrum received from second layer decoding section 1303 and calculates the second layer decoded signal which is a time domain signal. Orthogonal transform processing section 1308 outputs the calculated second layer decoded signal to adding section 1309. Because an orthogonal transformation process in orthogonal transform processing section 1308 is similar to the orthogonal transformation process in orthogonal transform processing section 808 (FIG. 9) in Embodiment 1, the description thereof will be omitted.

Adding section 1309 receives the first layer decoded signal from first layer decoding section 802 and receives the second layer decoded signal from orthogonal transform processing section 1308. Adding section 1309 adds the received first layer decoded signal and second layer decoded signal and outputs the added signal as an output signal.

Figure 14:
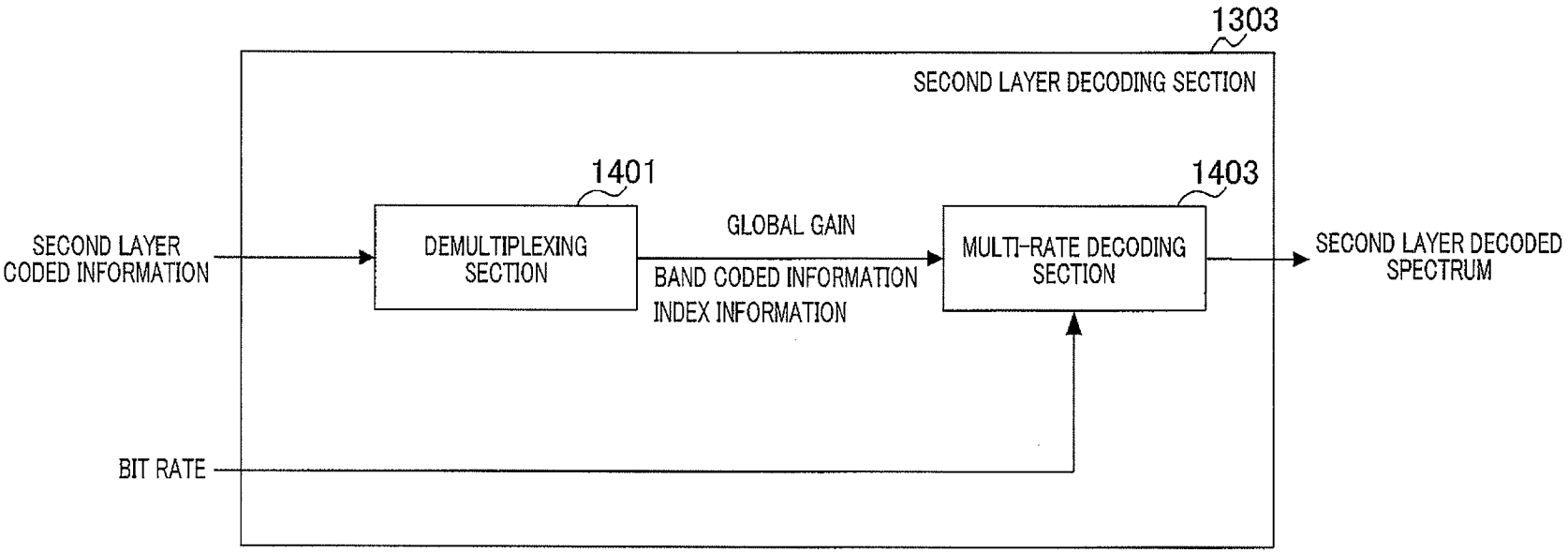
FIG. 14 is a block diagram showing a main configuration inside the second layer decoding section shown in FIG. 13.

FIG. 14 is a block diagram showing a main configuration inside second layer decoding section 1303 shown in FIG. 13. Second layer decoding section 1303 is mainly formed of demultiplexing section 1401 and multi-rate decoding section 1403.

Demultiplexing section 1401 demultiplexes the second layer coded information outputted from coded information demultiplexing section 1301 into index information, band coded information, and a global gain. Demultiplexing section 1401 then outputs the index information, the band coded information, and the global gain to multi-rate decoding section 1403.

Multi-rate decoding section 1403 decodes the global gain, the index information, and the band coded information which are received from demultiplexing section 1401 and calculates the second layer decoded spectrum. At this time, multi-rate decoding section 1403 performs a decoding process according to a bit rate received from coded information demultiplexing section 1301. Hereinafter, a method of controlling a process in multi-rate decoding section 1403 will be described.

Multi-rate decoding section 1403 decodes index information on the number of bits corresponding to the bit rate with respect to a frequency band determined from the received band coded information and calculates the second decoded spectrum. Specifically, multi-rate decoding section 1403 decodes index information from the frequency band corresponding to the top subband in sequence from higher frequency in the frequency domain by associating a frequency band indicated by the band coded information with the top subband included in the index information. At this time, multi-rate decoding section 1403 sets a value of the second decoded spectrum to zero in a lower frequency than the frequency band indicated by the band coded information. Similarly, multi-rate decoding section 1403 sets a value of the second decoded spectrum to zero in a higher frequency than the frequency band corresponding to the index information. In other words, multi-rate decoding section 1403 decodes only index information (the index information on the important subband group) which is included in the second layer coded information as a spectrum of a corresponding frequency band.

Multi-rate decoding section 1403 then outputs the calculated second layer decoded spectrum to orthogonal transform processing section 1308.

A process in decoding apparatus 113 has been described above.

The present embodiment partially selects a specific coded parameter which is perceptually important in a coding apparatus and reflects the degree of the perceptual importance on a coded parameter, in a configuration employing an AVQ coding scheme applicable to a plurality of coding bit rates, as with Embodiment 1. Accordingly, the quality of a decoded signal can be improved according to a coding bit rate. According to the present embodiment, a coded parameter (coded information) generating process is performed by a coding process taking into account the degree of perceptual importance. Thus, the quality of a decoded signal can be improved, as with Embodiment 1.

The embodiments of the present invention have been described.

In each embodiment, a case has been described where the candidate entry in determining the important subband group in the band selecting section is not particularly limited (it is noted that the important subband group is limited to a group of continuous subbands). The present invention, however, is not limited thereto and is similarly applicable to a configuration for efficiently narrowing the candidate entry in a band selecting section (for example, band selecting section 304 (FIG. 3) or band selecting section 1204 (FIG. 12)). A specific example will be explained below. For example, the band selecting section can reduce the number of candidate entries by setting a limitation that the important subband group always includes a subband having the highest subband energy. In this manner, it is made possible to reduce the amount of calculation processing upon searching for the important subband group by reducing the number of candidate entries. Band selecting section can reduce the number of candidate entries by not taking into account a subband having a subband energy less than or equal to a certain threshold (i.e., estimating the energy of the subband as 0). Specifically, the band selecting section selects a selection range of subbands (i.e., entry) where a total number of coding bits assigned to each subband is less than or equal to a preset value and a selection range of subbands (i.e., entry) where a total subband energy is the highest using only a subband having a subband energy more than or equal to a threshold, among a plurality of subbands. Accordingly, the band selecting section searches for only a candidate entry which starts with a subband whose subband energy is not zero, and can therefore significantly reduce the amount of calculation processing.

Each embodiment sets a limitation that a candidate entry in determining the important subband group does not protrude from the borders of the top subband and the end subband in band selecting section. However, the present invention is not limited thereto, and is similarly applicable to a configuration that the candidate entry may protrude from the borders of the top subband and the end subband. Specifically, a case of searching for the candidate entry of the important subband group by rotating a sequence of subbands will be given as an example. For example, a coding apparatus (i.e., a band selecting section) may determine a selection range which is an important subband group from a plurality of subbands generated by dividing the spectrum data obtained by linking the top and end of spectrum data acquired by an orthogonal transformation on an input signal, and rotating the spectrum data. In this way, rotating a sequence of subbands eliminates the limitation of a candidate entry and thus searching for a specific subband group which is more perceptually important than the important subband group described in the present embodiment is possible. However, in the case of the above mentioned configuration, the groups of subbands must be rearranged under a condition where a sequence of subbands is rotating, and thus a larger amount of calculation processing than the configuration described in the present embodiment may be required, in a decoding process.

Each embodiment has described a configuration for transmitting a frequency band corresponding to a top subband of an important subband group to a decoding apparatus as band coded information. Accordingly, the number of additional coding bits is required in addition to the number of coding bits in conventional techniques. However, the present invention is not limited thereto, and is similarly applicable to a configuration for calculating frequency band information corresponding to a top subband of an important subband group using a low-order decoded spectrum. Accordingly, the quality of a decoded signal can be improved without an additional bit. Specifically, an example of using a subband energy of a decoded spectrum is given.

Each embodiment has described a case where a coding apparatus independently selects a specific subband group which is perceptually important (i.e., an important subband group) every frame. The present invention is not limited thereto, and is similarly applicable to a configuration in which a coding apparatus selects an important subband group in a current frame by taking into account a selection result of a previous frame in time. For example, an example includes a configuration in which a band in the vicinity of a band selected as an important subband group in a previous frame is determined as a selection candidate of an important subband group of a current frame. Or, the coding apparatus may determine a selection range (a selection candidate) of an important subband group from a plurality of subbands by using a weighting factor such that a subband which is closer to a subband selected as an important subband group in the previous frame is likely to be selected as an important subband group in a current frame. These configurations can limit a large fluctuation of a band of an important subband group between frames, and thus limit the quality of a decoded signal.

In each embodiment, a coding apparatus selects a specific band which is perceptually important after performing a multi-rate indexing process. The present invention is not limited thereto, and is likewise applicable to a configuration for selecting a specific band which is perceptually important before a multi-rate indexing process. In this configuration, however, the number of bits used for encoding each subband is not determined at the time of band selection, and therefore the coding apparatus uses an estimation value of the number of coding bits temporarily. Specifically, a configuration in which the same number of coding bits is set for all subbands is given as an example. In other words, the coding apparatus (the band selecting section) determines a selection range (a selection candidate) which is an important subband group from a plurality of subbands, using a preset fixed number of bits as the number of coding bits assigned to each of a plurality of subbands. Because this configuration integrates the number of bits used for encoding each subband, the amount of calculation processing can be reduced in band selection.

Spectrum data represented by a vector has been representatively used as a coding target in each embodiment, but the embodiment is not limited to this case. The same effect can be obtained using data other than the aforementioned spectrum data, which can represent the characteristics of an input signal by a vector, as a coding target.

Decoding apparatus 103 according to each embodiment performs a process using coded information transmitted from the above mentioned coding apparatus 101. The present invention is not limited thereto, however. The decoded information does not have to be one from the aforementioned coding apparatus 101. Actually, decoding apparatus 103 can perform a process using any coded information as long as the coded information includes a necessary parameter or data.

In each embodiment, an input signal to be encoded and an output signal resulting from decoding are described as being a speech signal, but the embodiment is not limited thereto. For example, an input signal or an output signal may be a music signal, or a mixture of a speech signal and a music signal.

The present invention is similarly applicable to a case where a signal processing program capable of implementing the above mentioned function is recorded or written in a computer-readable recording medium such as a memory, disk, tape, CD and DVD and operated, and provides the same working effects and advantages as with the present embodiment.

Although an example of the present invention configured as hardware has been described in each of the present embodiments, the present invention may also implement software in collaboration with hardware.

Each function block employed in the description of each of the aforementioned embodiments may typically be implemented as an LSI constituted by an multiplexed circuit. These may be implemented individually as single chips, or a single chip may incorporate some or all of the function blocks "LSI" is adopted herein but this may also be referred to as "IC," "system LSI," "super LSI," or "ultra LSI" depending on differing extents of integration.

The method of implementing multiplexed circuitry is not limited to LSI, and therefore implementation by means of dedicated circuitry or a general-purpose processor may also be used. After LSI production, utilization of an FPGA (Field Programmable Gate Array) or a reconfigurable processor where connections and settings of circuit cells in an LSI can be reconfigured may also be possible.

In the event of the introduction of a circuit implementation technology whereby LSI is replaced by a different technology, which is advanced in or derived from semiconductor technology, integration of the function blocks may of course be performed using technology therefrom. An application to biotechnology and/or the like is also possible.

The disclosure of Japanese Patent Application No. 2010-096095, filed on Apr. 19, 2010, including the specification, drawings and abstract, is incorporated herein by reference in its entirety.

INDUSTRIAL APPLICABILITY

A coding apparatus, a decoding apparatus, a coding method, and a decoding method according to the present invention can improve the quality of a decoded signal with a very low bit rate and a small amount of calculation processing by performing a coded parameter generating process using a coding process taking into account a degree of perceptual importance. Accordingly, the coding and decoding apparatuses and methods are suitable for a packet communication system, mobile communication system and/or the like.

REFERENCE SIGNS LIST

101, 111 Coding apparatus
102 Transmission channel
103, 113 Decoding apparatus

201 First layer coding section
202, 802 First layer decoding section
203, 207, 210, 805, 807, 809, 1309 Adding section
204, 808, 1104, 1308 Orthogonal transform processing section
205, 1105 Second layer coding section
206, 803, 1303 Second layer decoding section
208 Third and fourth layer coding section
209, 804 Third and fourth layer decoding section
211 Fifth layer coding section
212, 1112 Coded information integrating section
301 Global gain calculating section
302 Neighborhood search section
303 Multi-rate indexing section
304, 1204 Band selecting section
305, 702, 1002 Index information adjusting section
306 Multiplexing section
701, 1001, 1401 Demultiplexing section
703, 1003, 1403 Multi-rate decoding section
801, 1301 Coded information demultiplexing section
806 Second layer decoding section

The invention claimed is:

1. A speech coding apparatus that includes at least one lower coding layer and at least one higher coding layer for performing coding processes together, the at least one higher coding layer including a first layer that is higher than the at least one lower coding layer, and a second layer that is higher than the first layer, the speech coding apparatus comprising:

a receiver that receives an incoming speech signal, the incoming speech signal being inputted to the at least one lower coding layer and used to generate (i) coded information generated by the at least one lower coding layer, and (ii) difference spectrum data based on the incoming speech signal and the decoded signals of the coded information of the at least one lower coding layer;

a searching processor that divides the difference spectrum data inputted to the at least one higher layer to generate a plurality of subbands, and performs a neighborhood search for the plurality of subbands to calculate lattice vectors for the spectra of the plurality of subbands;

an encoder that performs multi-rate indexing for each of the plurality of subbands using a corresponding one of the lattice vectors, to generate index information indicating a result of the multi-rate indexing for each of the plurality of subbands;

a selector that determines a selection range of subbands as a specific subband group in the at least one higher coding layer among the plurality of subbands using the number of coding bits assigned to each of the plurality of subbands in the index information and a subband energy which is an energy of each of the plurality of subbands, the selection range of subbands being one of entries in which a total number of the coding bits is equal to or less than a number of the coding bits assigned to the first layer and the selection range of subbands being an entry in which a total of the subband energies is the highest among the entries, each of the entries being a set of continuous subbands in a case where subbands are arranged in ascending or descending order of frequency;

an adjustor that rearranges the index information such that a part corresponding to the specific subband group in the index information is located at the top of the index information, and the subbands other than the specific subband group follow the specific subband group while maintaining the ascending or the descending order of frequency; and a transmitter that transmits the coded information, the rearranged index information, and band information indicating the specific subband group as an encoded speech signal over a transmission channel to a decoding apparatus, wherein the speech coding apparatus uses the at least one higher coding layer to encode the incoming speech signal using a specific coded parameter that reflects a degree of perceptual importance to improve encoded speech signal quality using part of bit rates, and wherein the selection range of subbands includes a subband having the highest subband energy.

2. The speech coding apparatus according to claim 1, wherein the selector determines the selection range which is the specific subband group from the plurality of subbands, using a weighting factor such that a subband which is closer to a subband selected as the specific subband group in a previous frame is likely to be selected as the specific subband group in a current frame.

3. The speech coding apparatus according to claim 1, wherein the number of coding bits assigned to each of the plurality of subbands is the number of bits used for the multi-rate indexing for each of the subbands.

4. The speech coding apparatus according to claim 1, wherein the selector determines the selection range which is the specific subband group from the plurality of subbands, using a preset fixed number of bits as the number of coding bits assigned to each of the plurality of subbands.

5. The speech coding apparatus according to claim 1, wherein the selector determines the selection range which is the specific subband group from the plurality of subbands, using only a subband having a subband energy equal to or more than a threshold among the plurality of subbands.

6. The speech coding apparatus according to claim 1, wherein the selector determines the selection range which is the specific subband group from the plurality of subbands generated by dividing spectrum data acquired by linking the top and end of the spectrum data and then rotating the spectrum data.

7. A communication terminal apparatus comprising the speech coding apparatus according to claim 1.

8. A base station apparatus comprising the speech coding apparatus according to claim 1.

9. A speech decoding apparatus that decodes a signal from a speech coding apparatus including at least one lower coding layer and at least one higher coding layer for performing coding processes together, the at least one higher coding layer including a first layer that is higher than the at least one lower coding layer, and a second layer that is higher than the first layer, the speech decoding apparatus comprising:

a receiver that receives an encoded speech signal over a transmission channel, including coded information generated by the at least one lower coding layer, index information, and band information which are generated in the speech coding apparatus, the index information indicating a result of multi-rate indexing for each of a plurality of subbands generated by dividing spectrum data inputted to the at least one higher layer, using a lattice vector acquired by a neighborhood search for the plurality of subbands, band information indicating a specific subband group which is a selection range of subbands and being determined among the plurality of subbands using coding bits assigned to each of the plurality of subbands and a subband energy which is an energy of each of the plurality of subbands, the selection range of subbands being one of entries in which a total number of coding bits assigned to each of the plurality of subbands in the multi-rate indexing is equal to or less than a number of the coding bits assigned to the first layer and the selection range of subbands being an entry in which a total of subband energies which are the energies of the plurality of subbands is the highest among the entries, each of the entries being a set of continuous subbands in a case where subbands are arranged in ascending or descending order of frequency, and the index information being rearranged at the speech coding apparatus such that a part corresponding to the specific subband group in the index information is located at the top of the index information, and the subbands other than the specific subband group follow the specific subband group while maintaining the ascending or the descending order of frequency;

an adjustor that performs a rearrangement process which is reversal of a rearrangement process in the speech coding apparatus on the index information when the decoding process is performed in the at least one higher coding layer and that does not perform the rearrangement process on the index information when the decoding process is performed in only a part of at least one higher coding layer;

a decoder that decodes only a part corresponding to the specific subband group indicated by the band information, in the index information, to generate a decoded signal when a decoding process is performed in only part of the at least one higher coding layer; and at least one lower coding layer decoder that decodes the coded information of the at least one lower coding layer to generated a lower decoding layer signal to be added to the decoded signal, wherein at least one of the receiver and the decoder is configured as a circuit or as a processor, and wherein the speech decoding apparatus uses at least one higher coding layer to decode the incoming speech signal using a specific coded parameter that reflects a degree of perceptual importance to improve decoded speech signal quality using part of bit rates, and wherein the selection range of subbands includes a subband having the highest subband energy.

10. A communication terminal apparatus comprising the speech decoding apparatus according to claim 9.

11. A base station apparatus comprising the speech decoding apparatus according to claim 9.

12. A speech coding method in a coding apparatus including at least one lower coding layer and at least one higher coding layer for performing coding processes together, the at least one higher coding layer including a first layer that is higher than the at least one lower coding layer, and a second layer that is higher layer than the first layer, the speech coding method comprising:

receiving, by a receiver, an incoming speech signal, the incoming speech signal being inputted to the at least one lower coding layer and used to generate (i) coded information generated by the at least one lower coding layer, and (ii) difference spectrum data based on the incoming speech signal and the decoded signals of the coded information of the at least one lower coding layer;

dividing, by a processor, the difference spectrum data inputted to the at least one higher coding layer to generate a plurality of subbands, and performing a neighborhood search for the plurality of subbands to calculate lattice vectors for the spectra of the plurality of subbands;

performing, by an encoder, multi-rate indexing for each of the plurality of subbands using a corresponding one of the lattice vectors, to generate index information indicating a result of the multi-rate indexing for each of the plurality of subbands;

determining, by a selector, a selection range of subbands as a specific subband group in the at least one higher coding layer among the plurality of subbands using the number of coding bits assigned to each of the plurality of subbands in the index information and a subband energy which is an energy of each of the plurality of subbands, the selection range of subbands being one of entries in which a total number of the coding bits is equal to or less than a number of the coding bits assigned to the first layer and the selection range of subbands being an entry in which a total of the subband energies is the highest among the entries, each of the entries being a set of continuous subbands in a case where subbands are arranged in ascending or descending order of frequency;

rearranging, by an adjustor, the index information such that a part corresponding to the specific subband group in the index information is located at the top of the index information, and the subbands other than the specific subband group follow the specific subband group while maintaining the ascending or the descending order of frequency; and transmitting, by a transmitter, the coded information, the rearranged index information, and band information indicating the specific subband group as an encoded signal over a transmission channel to a decoding apparatus, wherein the speech coding apparatus uses the at least one higher coding layer to encode the incoming speech signal using a specific coded parameter that reflects a degree of perceptual importance to improve encoded speech signal quality using part of bit rates, and wherein the selection range of subbands includes a subband having the highest subband energy.

13. A speech decoding method in a speech decoding apparatus that decodes a signal from a speech coding apparatus including at least one lower coding layer and at least one higher coding layer for performing coding processes together, the at least one higher coding layer including a first layer that is higher than the at least one lower coding layer, and a second layer that is higher layer than the first layer, the speech decoding method comprising:

receiving, by a receiver, an encoded speech signal over a transmission channel, including coded information generated by the at least one lower coding layer, index information, and band information which are generated in the coding apparatus, the index information indicating a result of multi-rate indexing for each of a plurality of subbands generated by dividing spectrum data inputted to the at least one higher coding layer, using a lattice vector acquired by a neighborhood search for the plurality of subbands, band information indicating a specific subband group which is a selection range of subbands and being determined among the plurality of subbands using coding bits assigned to each of the plurality of subbands and a subband energy which is an energy of each of the plurality of subbands, the selection range of subbands being one of entries in which a total number of coding bits assigned to each of the plurality of subbands in the multi-rate indexing is equal to or less than a number of the coding bits assigned to the first layer and the selection range of subbands being an entry in which a total of subband energies which are energies of the plurality of subbands is the highest among the entries, each of the entries being a set of continuous subbands in a case where subbands are arranged in ascending or descending order of frequency, and the index information being rearranged at the speech coding apparatus such that a part corresponding to the specific subband group in the index information is located at the top of the index information, and the subbands other than the specific subband group follow the specific subband group while maintaining the ascending or the descending order of frequency;

performing, by an adjustor, a rearrangement process which is reversal of a rearrangement process in the speech coding apparatus on the index information when the decoding process is performed in the at least one higher coding layer and that does not perform the rearrangement process on the index information when the decoding process is performed in only a part of the at least one higher coding layer;

decoding, by a decoder, only part corresponding to the specific subband group indicated by the band information, in the index information, to generate a decoded signal when a decoding process is performed in only part of the at least one higher coding layer;

at least one lower coding layer decoder that decodes the coded information of the at least one lower coded layer to generate a lower coding layer decoded signal to be added to the decoded signal, wherein the speech decoding method uses the at least one higher coding layer to decode the incoming speech signal using a specific coded parameter that reflects a degree of perceptual importance to improve decoded speech signal quality using part of bit rates, and wherein the selection range of subbands includes a subband having the highest subband energy.

* * * * *